US005765494A

United States Patent [19]

Adamski, Jr. et al.

[11] Patent Number: 5,765,494

[45] Date of Patent: Jun. 16, 1998

[54] SLEEVE MAKING METHOD AND APPARATUS

[75] Inventors: Maximilian Adamski, Jr., Tega Cay, S.C.; Stephen S. Ruderman, Matthews, N.C.; Chengyu Sun, Fort Mill, S.C.; Carlton I. McElwain, Kings Mountain, N.C.; Kevin L. Lunsford, Blairsville, Ga.

[73] Assignee: Union Special Corporation, Huntley, Ill.

[21] Appl. No.: 608,057

[22] Filed: Feb. 28, 1996

Related U.S. Application Data

[63] Continuation-in-part of Ser. No. 405,741, Mar. 16, 1995, Pat. No. 5,628,264.

[51] Int. Cl.[6] ..... D05B 21/00; D05B 25/00; D05B 35/02; D05B 35/10

[52] U.S. Cl. ..... 112/470.07; 112/153; 112/475.03; 112/475.07; 112/DIG. 2

[58] Field of Search ..... 112/475.03, 470.07, 112/475.07, 475.08, 153, 155, 304, 306, DIG. 2, 308, 309, 141, 143; 270/32

[56] References Cited

U.S. PATENT DOCUMENTS

| | | | |
|---|---|---|---|
| 3,252,437 | 5/1966 | Pickett | 112/DIG. 2 X |
| 4,455,954 | 6/1984 | Franck, III | 112/206 |
| 4,813,364 | 3/1989 | Boser | 112/304 |
| 5,197,722 | 3/1993 | Adamski, Jr. et al. | 270/32 |
| 5,226,378 | 7/1993 | Suzuki et al. | 112/155 X |

*Primary Examiner*—Peter Nerbun
*Attorney, Agent, or Firm*—Brinks Hofer Gilson & Lione

[57] ABSTRACT

A machine for automatically producing apparel sleeves that includes a station at which the sleeve blank is trimmed, folded and hemmed. Another station is provided at which the hemmed sleeve blank is folded and turned inside out. The sleeve blank must then be stopped at a position at which it is aligned with a seaming sewing machine and then transported to the sewing head of the seaming sewing machine. A curve generating mechanism then controls the sleeve blank as it is fed through the seaming sewing machine.

8 Claims, 23 Drawing Sheets

FIG. IC
STATION 4
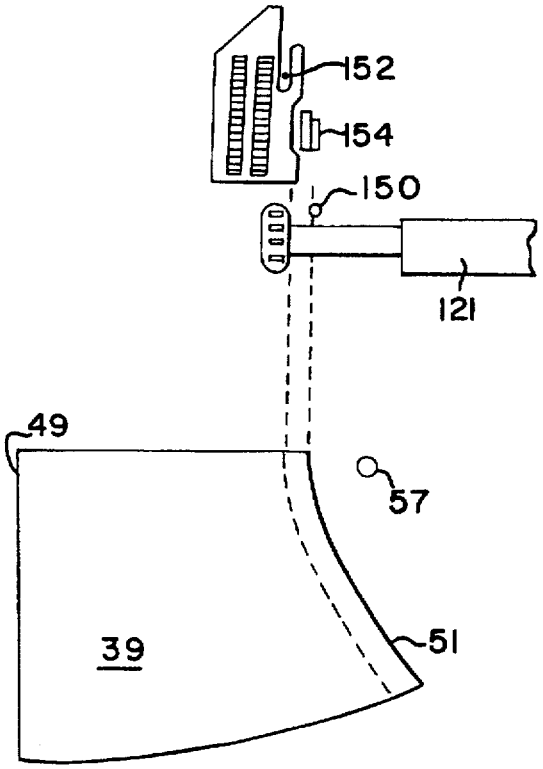
FIG. ID
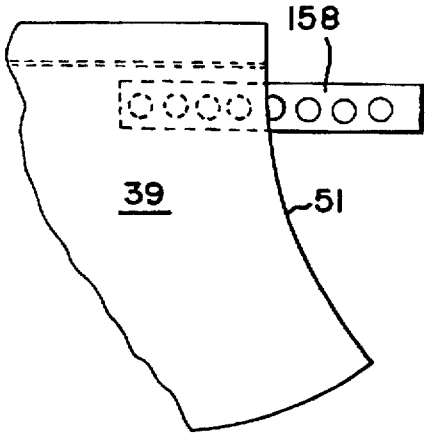
FIG. IE
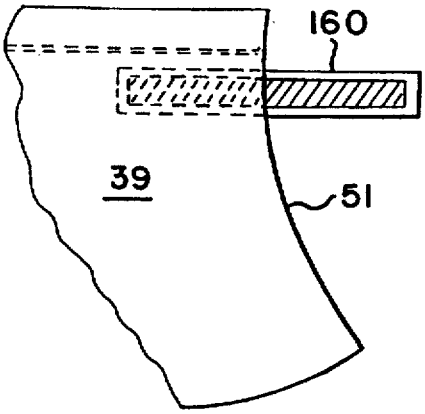

SLEEVE MAKING METHOD AND APPARATUS

CROSS-REFERENCES

The present application is a continuation in part of U.S. patent application Ser. No. 08/405,741 that was filed on Mar. 16, 1995, now U.S. Pat. No. 5,628,264.

BACKGROUND OF THE INVENTION

The present invention relates to a device and method for automatically hemming and seaming pre-cut workpieces such as sleeve blanks. In the preferred embodiment, the present invention includes a device and method for conveying the workpieces along a predetermined curve during seaming after the pre-cut workpiece has been hemmed, folded over and turned inside out. The invention also relates to maintaining control of the workpiece throughout subsequent sewing operations, such that predetermined stitch patterns are accurately followed.

In the manufacture of shirts, sleeve blanks are placed on an initial conveyor that carries the sleeve blank to a work station where an edge is trimmed and hemmed and then the blank is folded and turned inside out. When starting the hemming and folding operations the outer surface of the sleeve is facing up, while when performing the subsequent seaming operations the sleeve is folded inside out. A mechanism for folding and turning a sleeve blank inside out after it has been trimmed and hemmed is disclosed in U.S. Pat. No. 5,197,722, which patent is hereby included by reference as a part of this application. In this patent after an edge of the sleeve blank has been hemmed and the hemmed sleeve blank is being transported by the conveyor, the leading edge of the hemmed sleeve blank is recognized by a sensor. The sensor triggers a lifting apparatus which lifts the leading portion of the hemmed sleeve blank up and into a jaw. The jaw holds the leading portion of the hemmed sleeve blank stationary and a front air blower is actuated. The hemmed sleeve blank is folded in half and turned over as the conveyor continues to convey the remainder of the cloth underneath the jaw while the front air blower is exerting its force on the hemmed sleeve blank in the opposite direction. The jaw opens to release the leading portion of the hemmed sleeve blank and then the trailing edge of the hemmed sleeve blank passes a sensor which triggers a rear air blower. The rear air blower exerts its force in the direction of the conveyor movement and aligns the cloth and completes the fold.

In the prior art devices when the hemmed and folded sleeve blank reaches the distal end of the initial conveyor it is automatically picked up and deposited on a second work support surface for a seaming sewing machine that applies a seam to the workpiece as the workpiece is fed in a precise predetermined pattern. A hemming, folding and seaming machine for performing the above described operations is disclosed in U.S. Pat. No. 4,896,619, which patent is hereby included by reference as a part of this application.

In the above identified '619 patent, fabric sleeve blank is placed on one end of an initial conveyor by the machine operator. One edge of the fabric sleeve blanks are automatically hemmed by a sewing machine as they move along the initial conveyor. At the distal end of the initial conveyor the hemmed sleeve blanks are automatically picked up by a cloth pick-up device which folds the blanks and deposits them on either a second conveyor or a pickup table adjacent to the distal end of the conveyor. Various feed control mechanisms are disclosed for controlling the folded and hemmed sleeve blank as it is fed to the seaming sewing machine along a predetermined pattern that may include curves. Although the mechanisms disclosed in the '619 patent performs its intended function well, it does have limitations. For example, the machine operator loading the pre-cut sleeve blanks on the initial conveyor has adequate time to decrease the spacing between blanks by placing the blanks on the conveyor such that the edges overlap. This has the effect of increasing the output of the mechanism, and thus is a more efficient and economic procedure. However, when the blanks are placed on the initial conveyor with the edges overlapped, the overlapped edges interfere with each other where the cloth pick-up device attempts to pick up and fold the hemmed blanks. Furthermore, the various devices and methods used to control the folded sleeve blanks as they are fed to the seaming machine on the second conveyor are very expensive and complex, and require a large number of parts and assemblies. The prior art devices do not have sufficient control of the workpiece to automatically produce a seam that follows a predetermined curve or pattern. Still further, the prior art devices are limited in the length of seam that they can automatically produce and thus can not be used for longer sleeves. For these reasons a high productivity, lower cost device, that will hem, fold and produce a high quality seam, is needed. There is also a need for a machine that can produce a high quality sleeve that has a relative long length.

SUMMARY OF THE INVENTION

The present invention provides a device and method for handling cloth blanks. For example, sleeve blanks placed on a conveyor with their tips overlapped that are being transmitted along an initial conveyor system to a work station where an operation such as hemming is performed on the cloth blank to another work station that folds the cloth blank and turns it inside out, and then to another work station where the sleeve blank is stopped so that it can be transported to a seamer sewing machine.

In the preferred embodiment of the invention, the speed of the conveyor is constant during the hemming and folding operation, and the folded sleeve blank passes under a sensor which initiates a sleeve stop process after which the folded sleeve blank is picked up and transported to the seamer sewing machine. The preferred embodiment of the sleeve stop mechanism includes several optional features that can be eliminated depending upon the size, style and type of sleeve being processed. After the folded sleeve blank is stopped at the distal end of the initial conveyor, it is picked up by a seamer sleeve clamp which transports it to the sewing machine that produces the seam.

In another embodiment of the invention, after the hemming operation has been completed, the surface speed of the conveyor that is moving the cloth blank is increased. This is accomplished, for example, by providing a second group of continuous conveyor belts that are driven at a slightly increased speed over the downstream conveyor belts. As a result, after the hemming operation has been completed but before folding is of the sleeve blank is completed, the linear speed of the sleeve blank is increased which increases its separation from the succeeding sleeve blank and eliminates the overlapping tips of adjacent cloth blanks.

The preferred embodiment of the seamer sleeve clamp and transporter is activated by the central processing unit in response to a sensor that has recognized the presence of the folded sleeve blank. The sleeve clamp holds the folded sleeve blank against the smooth work surface and the transporter slides it into the line of feed of the seaming machine. The sleeve blank is sensed as it approaches the seamer sewing head which initiates the seaming and curve generation sequence.

The preferred embodiment of the curve generation system includes a sensor controlled edge guider that works in combination with a central processor controlled stepper motor driven side feed belt. The speed of the side feed belt is equal to and synchronized with the seaming sewing head during straight seaming and is increased when a curved seam is required. The speed of the side feed belt is increased to a rate that will cause the sleeve blank to follow the desired curve, while the edge guider is functioning to maintain an accurate trim margin.

Another embodiment of the invention that is used in the seaming operation includes a plurality of rollers that engage the upper surface of the sleeve blank, each of which is independently driven by an electric stepper motor or the equivalent. The plurality of rollers run at the same speed, which corresponds to the speed of the straight line feeder for the sleeve blank, when it is desired to seam along a straight line. However, when the seam is to follow a curved path, signals are sent from a central processing unit to the stepper motors causing them to change their speed such that the peripheral speed of the plurality of rollers change, which causes the blanks to follow predetermined curved paths. For example, when an arcuate seaming path is desired, the roller furthest from the center of the curve will rotate at the fastest speed, and rollers that are closer to the center of the curve will rotate at progressively slower speeds. As a result of this precision control of the sleeve blank on the second conveyor a much higher quality finished sleeve is obtained in less time.

BRIEF DESCRIPTION OF THE DRAWINGS

FIG. 1C is schematic top view of a sleeve blank and the seamer sewing machine sewing head.

FIG. 1D is a partial view of a sleeve blank and an array of edge guide sensors.

FIG. 1E is a partial view of a sleeve blank and a photo voltaic sensor array.

DETAILED DESCRIPTION OF THE DRAWINGS AND PREFERRED EMBODIMENTS

This invention can be used to produce sleeves for T-shirts. The cloth blanks for T-shirt sleeves can be cut from continuous lengths of tubular knitted material either on the fold or in the flat. For either cutting method a bundle of tubular material, containing a multiple number of plies, is laid out flat on a cutting table. The bundles thus have folded edges on their opposite sides. A bundle of tubular knitted material to be cut in the flat is shown in FIGS. 1 and 1A, and a bundle of tubular knitted material to be cut on the fold is shown in FIGS. 2 and 2A.

Figure 1:
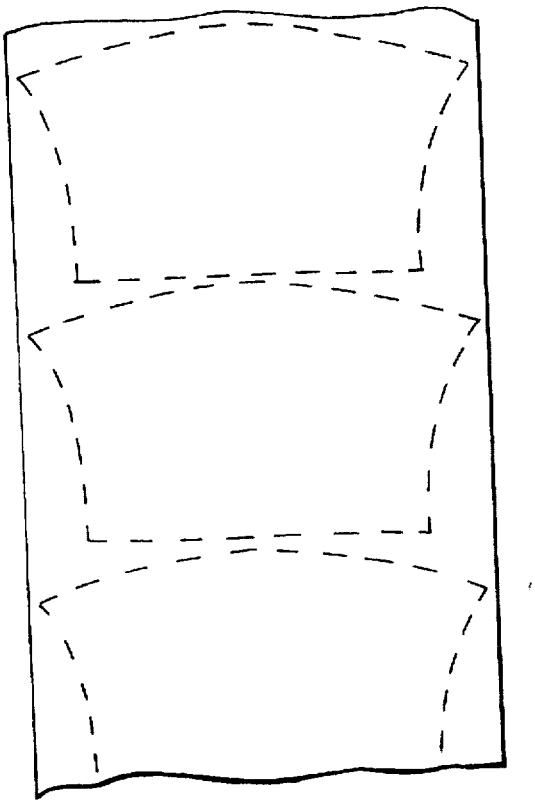
FIG. 1 is a top view of a stack of tubular sleeve fabric to be cut in the flat.
Figure 1A:
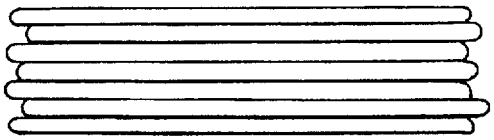
FIG. 1A is a side view of the bundle of FIG. 1.

FIG. 1 is a top view of a stack of tubular sleeve fabric with outlines of sleeve blanks to be cut in the flat from the fabric shown in broken lines. FIG. 1A is a side view of the stack of tubular sleeve fabric, seen in FIG. 1, showing the folded edges on its opposite sides. FIG. 1C is a side view of the stack of tubular sleeve fabric after it has been cut. It is apparent that all sleeve blanks are the same size. It should be noted that these figures are intended to illustrate that the folded edges are not included in the finished blank and all sleeve blanks are virtually the same size. These figures are not representative of how the various parts of a T-shirt would be laid out and cut from a continuous tube of fabric. When processing sleeve blanks that have been cut in the flat, the trailing edge sensor, hereinafter TES, technique is used.

Figure 2:
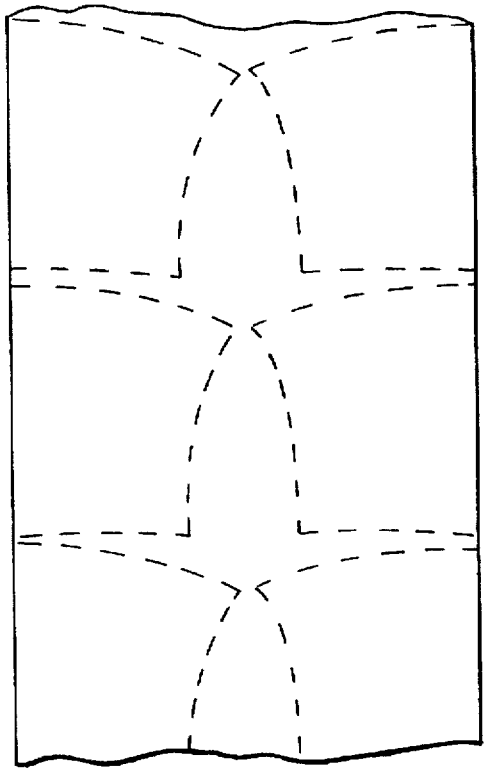
FIG. 2 is a top view of a stack of tubular sleeve fabric to be cut on the fold.
Figure 2A:
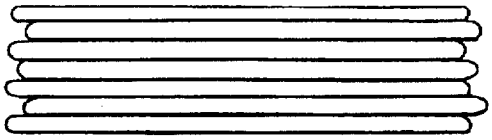
FIGS. 2A and 2B are side views of the bundle of FIG. 2.
Figure 1B:
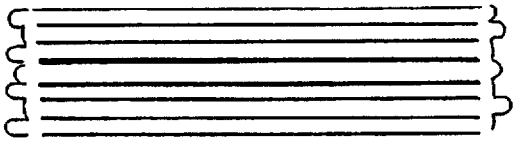
FIG. 1B is a view of the sleeve blanks after being cut.
Figure 2B:
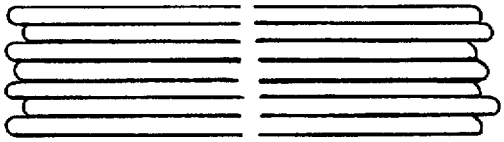

FIG. 2 is a top view of a stack of tubular sleeve fabric with an outline of a folded sleeve blank to be cut from the bundle shown in broken lines. In this Figure the fold in the sleeve blank coincides generally but not precisely with the fold in the tubular sleeve fabric. The sleeve blanks are cut in the folded condition. FIG. 2A is a side view of the bundle, seen in FIG. 2, showing the folded edges. As illustrated, the folded edges of the bundle are not aligned and as a result when the sleeve blanks are unfolded they will not all be the same size. FIG. 2B is a side view of the stack of tubular sleeve fabric after it has been cut. It is apparent that when these sleeve blanks are unfolded that they will not all be the same size. As stated above with respect to FIGS. 1 and 1A, these figures are intended to illustrate that the folded edges are included in the finished blank and all sleeve blanks will not be the same size. These figures are not representative of how the various parts of a T-shirt would be laid out and cut from a continuous tube of fabric. There is, however, less scrap material in the TES technique. When processing sleeve blanks that have been cut on the fold, the leading edge sensor, hereinafter LES, technique should be used if it is desired to produce sleeves having the same widths.

Referring to FIG. 1C which is a top view of a sleeve blank 39 that was cut in the flat and has been stopped at station 4 in response to the TES technique utilizing sensor 57. The machine is programmed to stop the sleeve blank 39 at station 4 such that when the sleeve blank 39 is transported to the seamer sewing head by the seamer sleeve clamp 71, sufficient trim margin is available to permit the seam to be closed at the start of sew even though the sleeve blank is not yet under the control of the edge guider 121. The needle 152, fabric trimming knife 154 and the throat plate 156 are shown in this view. In this situation the position of the edge guide sensor 150 is predetermined by the pre-programmed position of the trailing edge of the sleeve blank 39 at station 4.

However, if the sleeve blank 39 that has been stopped at station 4 had been cut on the fold and had been stopped at station 4 in response to the LES technique, utilizing sensor 57, then its trailing edge 51 would not always be aligned with the location of the edge guide sensor 150. In this situation it becomes necessary to adjust the position of the edge guide sensor 150 for each sleeve blank. A large investment in additional expensive mechanism, would be necessary to accomplish repositioning the edge guide sensor for each sleeve blank. Rather than making this large investment a simpler and less expensive, improved sensor concept can provide equally acceptable results.

In FIG. 1D the edge guide sensor 150 has been replaced with an array of sensors 158. When the sleeve blank is transported to the sewing head of the seamer sewing machine 91 by the seamer sleeve clamp 71 the trailing edge 51 of the sleeve blank is sensed by one of the sensors in the array of sensors 158 and this data is stored by the central processing unit 128. During the curve generation process the edge guider 121 will work from the sensor in the array that located the blank's trailing edge.

In FIG. 1E another optional arrangement for the edge guide sensor 150 is shown. In this arrangement the edge guide sensor 150 has been replaced by a photo voltaic light sensitive sensor array 160. The photo voltaic sensor will produce an analog voltage level proportional to the amount of the array that is covered by the sleeve blank and thus provides a sleeve edge positioning indication to the edge guider controls. The voltaic light sensitive sensor array 160 will provide more accurate edge sensing than the array of sensors 158 shown in FIG. 1D.

The LES technique provides acceptable results for sleeve blanks that have been cut in the flat. Thus, the optional edge guide sensors of FIGS. 1D and 1E can be used in the seaming process of sleeve blanks cut in the flat and on the fold.

Figure 3:
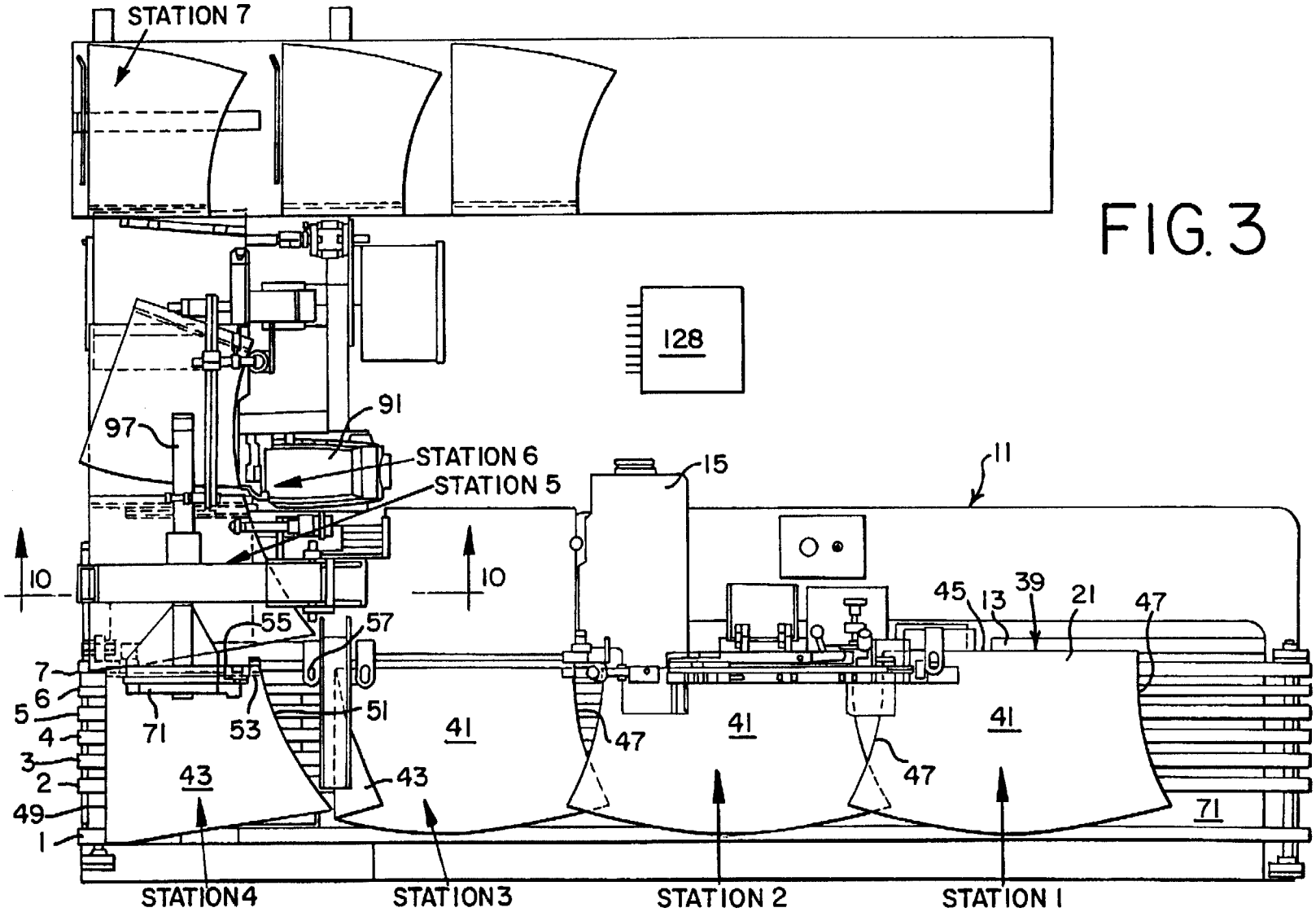
FIG. 3 is a plan view of a machine for hemming and seaming a sleeve blank as it progresses through a series of work stations.

FIG. 3 illustrates a preferred embodiment of a sleeve blank handling device that is to be used in the sewing operation. The operation is performed on a sleeve blank 39 as it is advanced through a series of seven stations. The sleeve blank 39 has an outer surface 41, inner surface 43, straight edge 45 and curved edges 47. At station 1, the operator places a pre-cut sleeve blank 39 with the outer surface 41 facing up on a set of moving conveyer belts 1–7 and aligns the sleeve with a bar 13. The upper rung of conveyor belts 1–7 that overlay and are supported by the smooth surface 17 of a support table 11. The conveyor belts 1–7 move the sleeve blank 39 into station 2.

At station 2, the straight edge 45 is trimmed and folded and a hem 53 is sewn by sewing machine 15.

The hemmed sleeve blank 39 is then carried by conveyor belts 1–7 to station 3 where the leading portion of the sleeve blank 39 is picked up and the sleeve blank is folded in half and turned inside out. The curved edges 47 are aligned and the aligned curved edges are placed in a trailing edge position. The inner surface 43 in now on the outside of the folded sleeve blank. In addition, the straight edge 45 now has a hem 53 extending there along.

The hemmed and folded in half sleeve blank 39 is then carried by the conveyor belts 1–7 to station 4. As seen at station 4 the folded in half sleeve blank 39 has a folded edge 49 that is straight, a trailing edge 51 that is curved, and a hemmed straight edge 55. At station 4 the sleeve blank 39 is grasped along the hemmed edge 55 by the seamer clamp 71 and transported to sewing head of the seamer sewing machine 91. It should be noted that the direction of movement of the sleeve blank 39 has now been changed, however to be consistent the terms that have been used to identify the edges of the sleeve blank 39 will not be changed. For example, the curved edge 51 which has been identified as the trailing edge 51 will continue to be identified as the trailing edge even though this edge extends generally in the new direction of travel of the sleeve blank 39.

As the folded sleeve blank 39 approaches station 4 it passes under a sew sensor 57. If the central processing unit 128 is programmed for the LES technique, the sew sensor 57 looks for the folded edge 49 and starts a belt count or a pulse count or a timer. After a pre-determined programmed time, the seamer clamp 71 is actuated downward to capture the hemmed edge 55 of the folded sleeve blank 39 against the smooth surface 17 of the support table 11.

If the central processing unit 128 has been programmed for the TES technique, then the sensor 57 looks for the trailing edge 51 of the folded sleeve blank 39, and after a pre-determined pulse count or time, actuates the seamer clamp 71 to capture the hemmed edge 55 of the folded sleeve blank 39 against the smooth surface 17, of the support table 11.

The operations performed at stations 1 and 2 such as trimming, folding and applying a two-needle 404 hemmer stitch, are conventional, and do not form a part of the present invention. A hemming, folding and seaming machine for performing the above described operations is disclosed in U.S. Pat. No. 4,896,619. Likewise, the operation performed at station 3 of folding the sleeve blank in half and turning it inside out does not form a part of the present invention. A mechanism for folding a sleeve blank in half and turning it inside out after it has been trimmed and hemmed is disclosed in U.S. Pat. No. 5,197,722. However, the operations performed at stations 1, 2 and 3 are an important part of applicants' new and improved sleeve production device.

Figure 4:
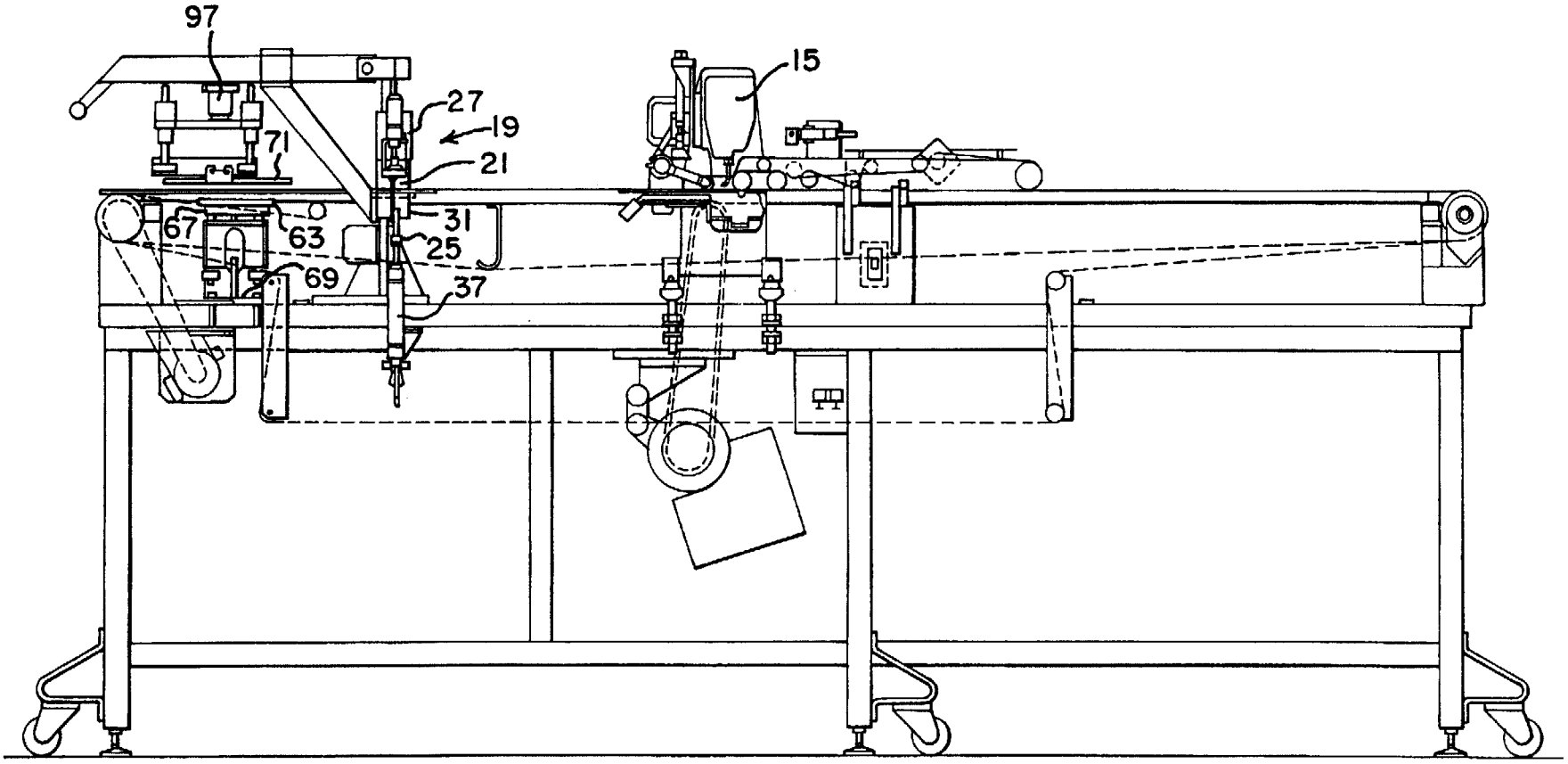
FIG. 4 is a side view of the machine seen in FIG. 3.
Figure 7:
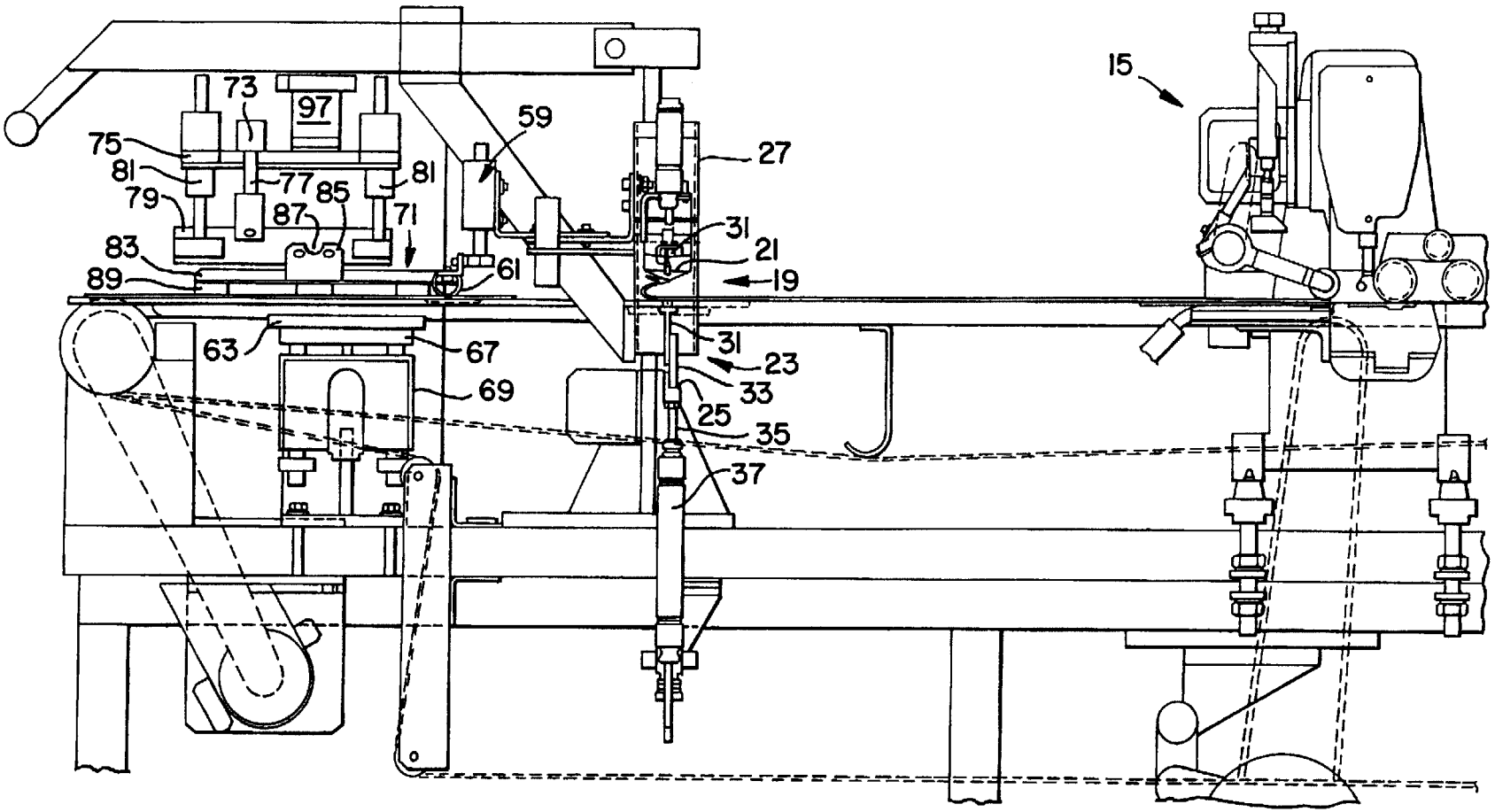
FIG. 7 is an enlarged and more detailed side view of stations 2, 3 and 4.

Referring to FIGS. 4 and 7, the mechanism for folding the sleeve blank 39 in half and turning it inside out, that is more completely disclosed in U.S. Pat. No. 5,197,722, will be discussed. The sleeve handling device 19 comprises a pick-up jaw assembly 21, positioned above, and a lifting assembly 23, positioned below the conveyor belts 1–7. The individual belts 1–7 are spatially arranged. A sensor is positioned before the jaw assembly 21 in the line of feed for the conveyor belts 1–7. The sensor is preferably a photosensitive sensor that transmits a first signal or no signal when the light beam is uninterrupted or uncovered and a second signal when the light beam is interrupted or covered.

The jaw assembly 21 and lifting assembly 23 are each pivotally attached to blocks 25, 27 by pins. Each assembly is attached such that it can be locked either perpendicular or at an angle with respect to the conveyor belts 1–7.

The jaw assembly 21 contains a pair of jaws pivotally attached to a block 27. The jaw may contain any number of opposable parts that open and close to hold the sleeve blank 39. The jaw assembly 21 may be actuated mechanically, electronically or a combination of both, and may be any type of construction or means for holding and releasing a piece of cloth, including a clamp or pincer.

The lifting assembly 23 contains a sleeve pick up blade 31 mounted to a base 33 that is attached to a rod 35. The sleeve pick-up blade may comprise one or more elongated blades, which, in cooperation with the rod 35, function to push the sleeve blank 39 toward the jaw assembly 21. The rod functions as a piston, and is attached within a housing 37 such that when the rod 35 reciprocates it carries the sleeve blade 31 towards and away from the jaw assembly 21.

While this device is described here in the context of a jaw assembly and lifting assembly, equivalent workpiece pickup means and lifting means are contemplated. For example a claw or pincer, of the type disclosed in U.S. Pat. No. 5,190,275, may be attached to an arm located above the conveyor. U.S. Pat. No. 5,190,275 is hereby made a part of this application by reference. The arm and claw would be activated at the appropriate time and pick up the workpiece. The pick up function could also be accomplished by pneumatic means located above the conveyor belts.

A forward air blower is attached to the support table 11 and functions as a means for separating sleeve blanks 39. A rear air blower is attached to the support table 11 that functions as a means for uncurling the leading edge of the sleeve blank 39. Both of the blowers extend horizontally over the width of the conveyor belts 1–7 and contain one or more air jet nozzles. The air jet nozzles direct the air jets toward the area below the jaw assembly 21. The front and rear blowers, sensor, jaw assembly 21, lifting assembly 23 and the motor that drives the conveyor belts 1–7 are controlled by central processing unit 128 which monitors the location of the sleeve blank 39 on the conveyor belts 1–7 and transmits signals between each of the above parts so that the sleeve blanks 39 are picked up, turned, aligned and folded at the appropriate time.

The operation of folding the sleeve blank 39 in half and turning it inside out is performed in stages, A, B, C and D, in which the direction of feed is from right to left as seen in FIGS. 4 and 7. In stage A sleeve blank 39 is resting on the conveyor belts 1–7 at a position where its leading edge will be detected by a sensor. When the leading edge passes below the sensor, a signal is generated which signals a counter, such as a shaft encoder, to begin counting pulses.

The invention is not limited to pulse counting, and may comprise any means for monitoring the position of the cloth on the conveyor belt and controlling the lifting and folding operation. Such means may be mechanical and may include digital motors and mechanical registration and encoder units, and may be computerized, and include central processing units which receive and transmit signals to actuate and stop the various operations and parts. Such means may also include a timer, a constant clock signal or a pulse counter, alone or in any combination.

In stage B, the jaw assembly 21, is in the open position. As the leading edge of the sleeve blank 39 passes under the pick up jaw assembly 21, the lifting assembly 23 is actuated at a predetermined pulse count, causing sleeve blade 31 to lift upwards and push the leading portion of the sleeve blank 39 into the open jaw of the jaw assembly 21. When more than two conveyor belts are used, the blade 31 may contain a number of extensions which contact the sleeve by passing through the spaces between the conveyor belts.

When the sleeve blank 39 is received, the jaw closes on the leading portion of the sleeve blank 39. The jaw can be actuated by mechanical or electrical means. In the case of mechanical action, the jaw assembly 21 could be constructed with a ball and spring arrangement which bear against the inside portion of the jaw. The jaw contacts the jaw assembly 21 the blade 31 opens and closes the jaw, and then immediately retracts from the jaw assembly 21. In the case of electrical action, the jaw assembly may be outfitted with a switch and motor which can be actuated by signals to open and close the jaw at the appropriate time.

The jaw holds the leading portion of the sleeve blank in a stationary position above the conveyor belts 1–7. The front blower is actuated to assist in starting and maintaining a smooth rolling action of the sleeve blank 39 as it is carried under the jaw assembly 21 by the conveyor belts 1–7.

In stage C, the blade 31 has retracted, and the sleeve blank 39 is turned over and folded at the middle by the combined action of the front blower and the conveyor belts 1–7 which continues to carry the remainder of the sleeve in the direction of the line of feed. As the sleeve blank 39 is turned inside out and folded, the hemmed edge 55 of the sleeve blank 39 is also aligned.

After the trailing edge of the sleeve blank 39 passes under the sensor in stage D, the jaw opens and releases the sleeve blank 39. A central processing unit 128 sends signals to actuate the jaw assembly 21 and cause the jaw to open upon receipt of a signal from the sensor.

At about the same time that the sleeve is released, the rear blower is turned on to blow air in the direction counter to the direction that the sleeve blank 39 is being conveyed. The blown air uncurls the tip and unfolds any unwanted folds in the sleeve blank 39, especially in the back portion. The air from the rear blower also aligns the tip of the sleeve, thus completing the fold.

Figure 32:
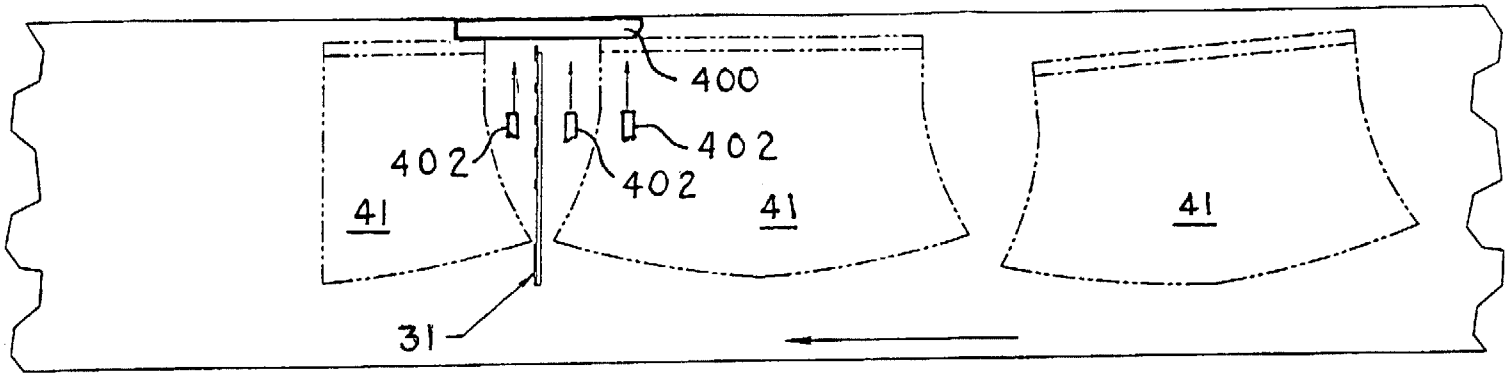
FIG. 32 is a top view of the support table including another embodiment of the invention that includes a series of air conduits that function to maintain the sleeve blank in alignment with the fixed edge guide.

After operation performed on the sleeve blank 39 at stations 1 and 2 and during the above discussed procedure for folding the sleeve blank in half and turning it inside out the hemmed edge sometime drifts such that it is not parallel to the direction of that the sleeve blank is moving. For example as seen in FIG. 32 the hemmed edge, of the sleeve blank to the right, is shown at an angle to its direction of travel. When this occurs, the curved edges may not be properly aligned after folding the sleeve blank in half. A fixed edge guide 400 has been provide, see FIG. 32, along the edge of the support table 11 that spans the location of the sleeve handling device 19. The pick up blade 31 which is shown in FIG. 32 identifies the location of the sleeve handling device 19. A series of air conduit tubes 402, that can be located either above the support table 11 or set in the surface of support table 11, have openings that direct air jets such that they impinges on the surface 41 of sleeve blank 39 and cause both the leading and trailing portions of the hemmed edge of the sleeve blank 39 into engagement with fixed edge guide 400. This mechanism causes the entire hemmed edge of the sleeve blank to travel in a straight line parallel to the line of feed and provides assurance that immediately before the pick-up blade 31 is actuated to move the sleeve into the jaw assembly 21. The air jets from air conduit tubes 402 are activated after the sensor that is positioned before the jaw assembly 21 recognizes the presence of a sleeve blank 39 and before the pick up blade is activated and remains on until after the jaw assembly 21 has released the sleeve blank 39. This assures that as the sleeve blank 39 is being folded the sleeve blank is held against the fixed edge guide 400 and when the jaw assembly 21 releases the sleeve blank 39, its leading hemmed edge is aligned with its trailing hemmed edge. This also assures that the curved edges of the sleeve blank 39 will be properly aligned.

Figure 33:
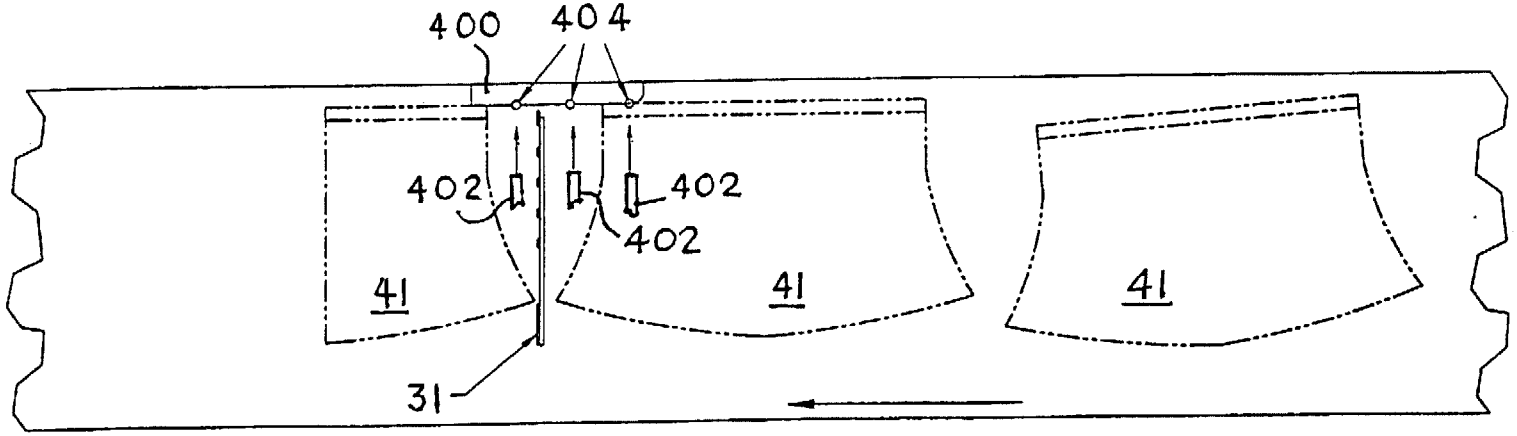
FIG. 33 is a top view of the support table showing a further improvement of the embodiment shown in FIG. 32.

There is illustrated in FIG. 33 a further improvement on the innovation shown in FIG. 32. In FIG. 33 a plurality of photocells 404 have been provided in the fixed edge guide 400. The photocells 404 are located both before and after the location of the pick up blade 31. The photocells 404 sense when the hemmed edge of the sleeve blank 39 is and is not against the fixed edge guide 400 and sends signals to the central processing unit 128. The central processing unit 128 can be programmed to respond to the signals from the photo cells 404 to adjust the jet streams that flow from the air conduit tubes 402. For example an electronically controlled pressure regulator or solenoid valve can be utilized to increase the pressure of the air streams until the photocells are satisfied and then the pressure can be reduced or reduced to zero. It should be noted that it would be undesirable to over drive the sleeve blank 39 into the fixed edge guide 400. If after the pressure of the streams have been reduced or turned off the sleeve blank 39 moves away from the fixed edge guide 400, the signal from the photo cells 404 will trigger the air jets to come back on and again move the hemmed edge of the sleeve blank 39 against the fixed edge guide 400.

When the folded sleeve blank is stopped at the proper position at station 4, the hemmed edge of the sleeve blank is resting on the flat smooth surface 17 of the support table. The seamer sleeve clamp 71 overlies the hemmed edge 55 of the sleeve blank 39. After a suitable delay by the central processing unit 128, the central processing unit 128 actuates the cylinder 73, causing the seamer sleeve clamp 71 to lower and hold the hemmed edge of the folded sleeve blank against the smooth surface 17 of the support table 11. The seamer sleeve clamp 71 has a plurality of pads 89, (see FIG. 9) disposed on its lower surface, to assure proper grip against the folded sleeve blank 39.

The seamer sleeve clamp 71 is connected to a sleeve transport device 97, which, when actuated, in response to a signal from the central processing unit 128, causes the clamp 71 to move to a position that is in the line of feed and adjacent the seamer sewing head of the seamer sewing machine 91. This position is just in front of the sewing head fabric trim knife. As the seamer clamp 71 moves to this position it slides the retained folded sleeve blank 39 with it over the smooth surface of the seamer work surface 17. A seamer sew sensor 93, such as a suitable photoelectric sensor, is located to sense the hemmed edge 55 of the folded sleeve blank 39 in order to indicate that the material is at the proper position for sewing.

As the folded sleeve blank 39 is transported to the sewing head, its hemmed edge 55 is sensed by the seamer sew sensor 93, which sends a signal to the central processing unit 128, which initiates the sewing and curve generation cycles. After the presser foot 95 is signaled by the central processing unit 128 to lower and capture the folded sleeve blank 39, and before sewing starts the seamer clamp 71 is caused to raise and release the folded sleeve blank 39. The transport device 97 is then signaled to return the seamer clamp 71 to its home position to be ready to retrieve another folded sleeve blank 39.

Figure 5:
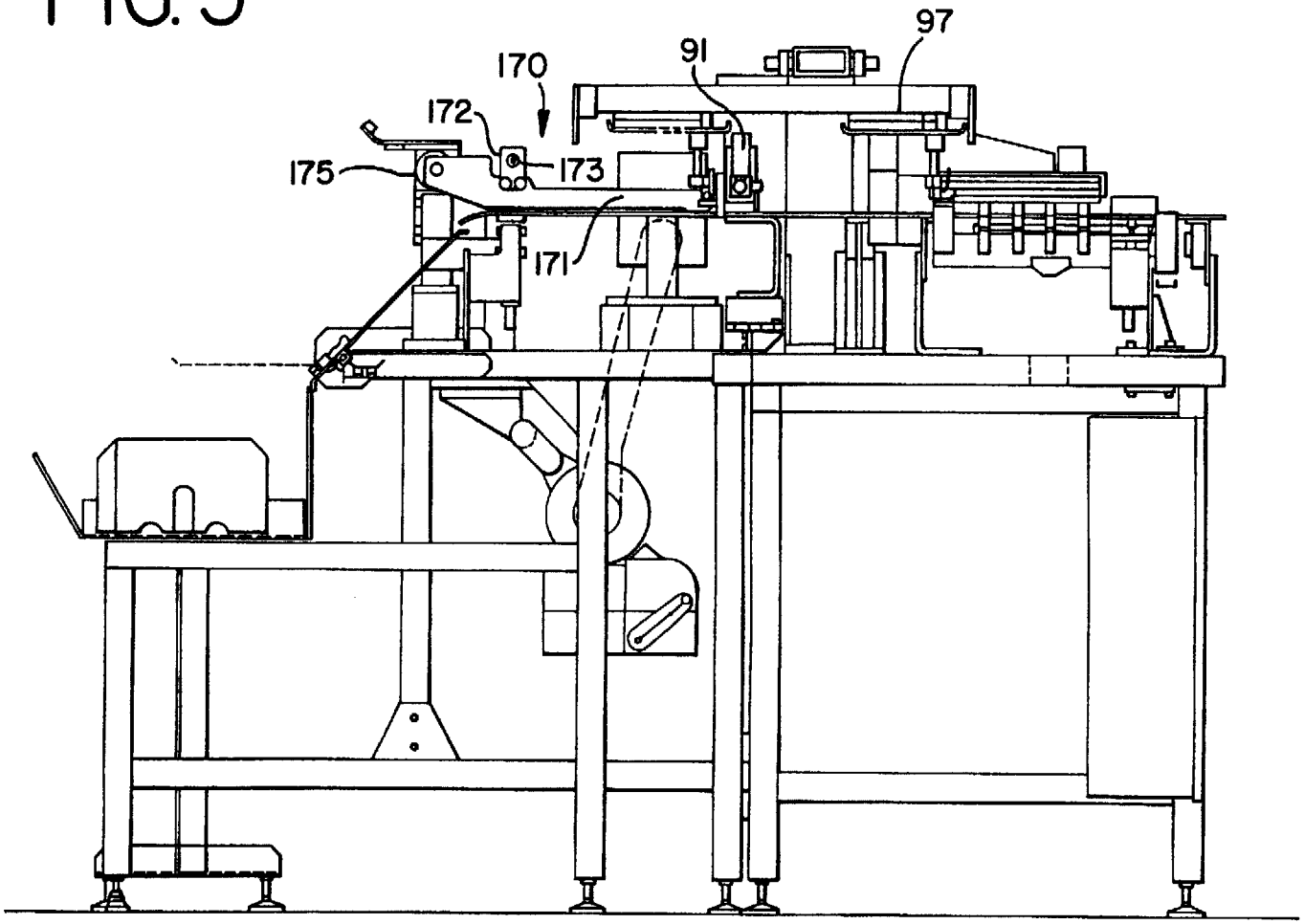
FIG. 5 is an end view of the machine seen in FIG. 3.
Figure 6:
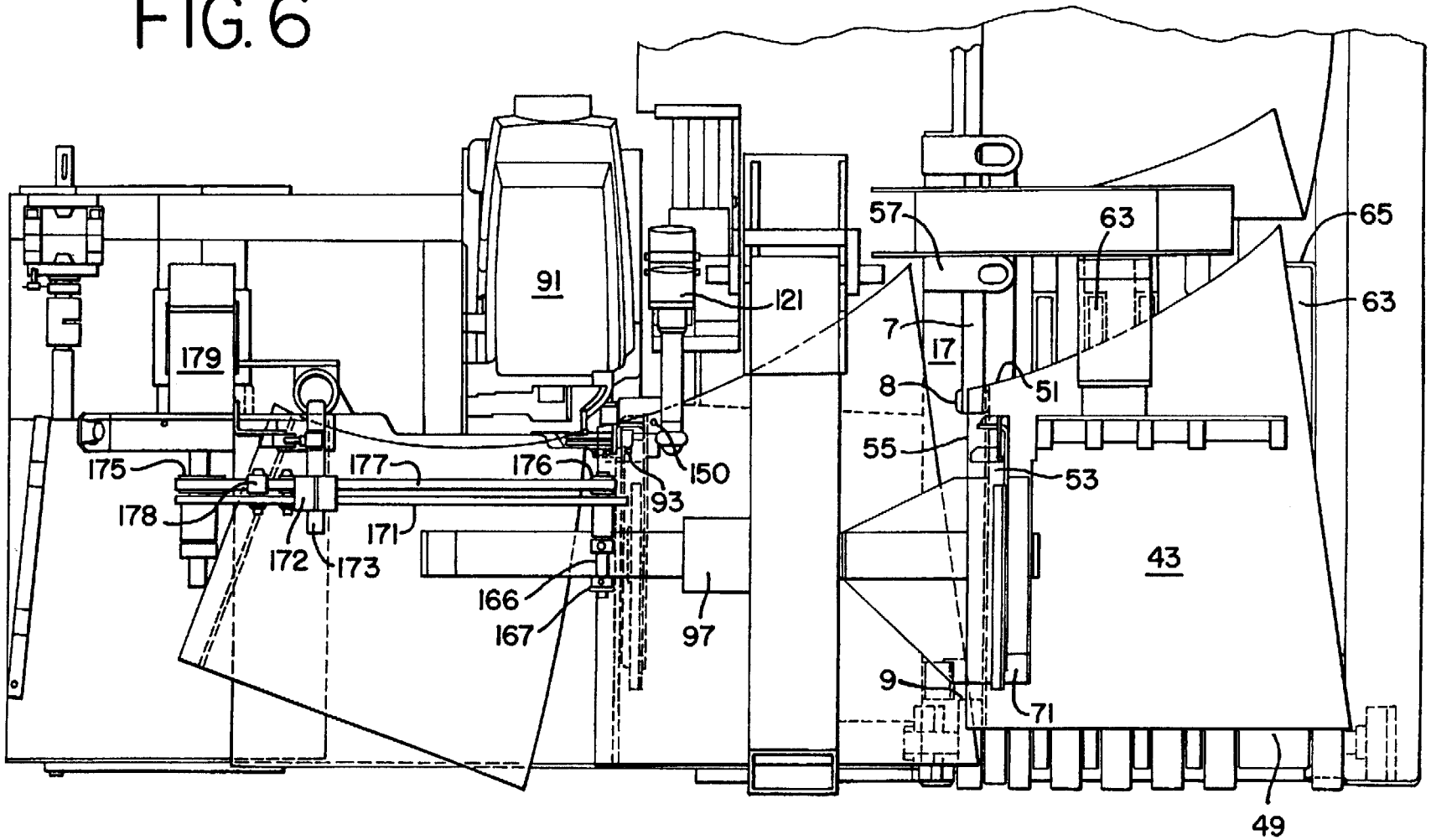
FIG. 6 is an enlarged and more detailed plan view of stations 4, 5 and 6.

Referring now to FIGS. 4–9, the preferred embodiment of the sleeve stop mechanism, located at station 4, will be described. As best seen in FIG. 6, the sew sensor 57 is located such that it can be programmed to recognize either the folded edge 49 or trailing edge 51 of the sleeve blank 39. The upper rungs of all of the conveyor belts 1, 2, 3, 4, 5 and 6 are supported on the smooth surface 17 of the support table 11 for their entire length. However, conveyor belt 7 extends downward through an opening 8 formed in the smooth surface 17 and reemerges through another opening 9 near the distal end of the conveyors. Thus, between the openings 8 and 9, the smooth surface 17 is not covered by the conveyor belt 7. The pads 89 of the seamer sleeve clamp 71 overlay the portion of smooth surface 17 that extends between openings 8 and 9. If the central processing unit 128 is programmed for the LES technique, the sew sensor 57 looks for the folded edge 49 and starts a belt count or a pulse count or a timer. After a pre-determined programmed time the seamer clamp 71 is actuated downward to capture the hemmed edge of the folded sleeve blank 39 against the smooth surface 17 of the support table 11. If the central processing unit 128 has been programmed for the TES technique then the sensor 57 looks for the trailing edge 51 of the folded sleeve blank 39 and after a predetermined pulse count or time, actuates the seamer clamp 71 to capture the hemmed edge of the folded sleeve blank 39 against the smooth surface 17 of the support table 11.

After the seamer sleeve clamp 71 has captured the sleeve blank 39 against the smooth surface 17 a signal is sent by the central processor 128 to the cylinder 99 of the transport device 97 causing it to be actuated and to slide the sleeve blank 39 across the smooth surface 17 to a position just forward of the sewing head of the seamer sewing machine 91. However, if greater stopping accuracy is required at station 4, a sleeve stop clamp 59 and/or a sleeve stop lift bar device 63 can be attached.

The sleeve stop clamp 59 is located above the smooth surface 17 and extends transverse to the direction of travel of the conveyor belts 1–7. The bottom surface of the sleeve stop clamp 59 has a series of pads 61 that are located such that when the sleeve stop clamp is lowered the pads 61 engage the smooth surface 17 between the conveyor belts 1–7. The sleeve stop clamp 59 is actuated by a signal from the central processing unit 128 in response to the sew sensor 57. When the sleeve stop clamp 59 is actuated, the sleeve blank 39 is clamped to the smooth surface 17, holding the sleeve blank 39 stationary while the conveyor belts 1–7 continue to move, just a moment before the seamer sleeve clamp 71 is actuated. As soon as the seamer sleeve clamp 71 captures the sleeve blank 39 the sleeve stop clamp 59 is deactivated and releases the sleeve blank 39. It should be noted that as seen in FIG. 6 the pads 61 of the sleeve stop clamp overlay the sleeve stop lift bars 63 which extend upwardly through openings 44 formed in the smooth surface 17. However, if a sleeve stop lift bar device is not utilized, the openings 44 are not present and the pads 61 align with the smooth surface 17.

Figure 8:
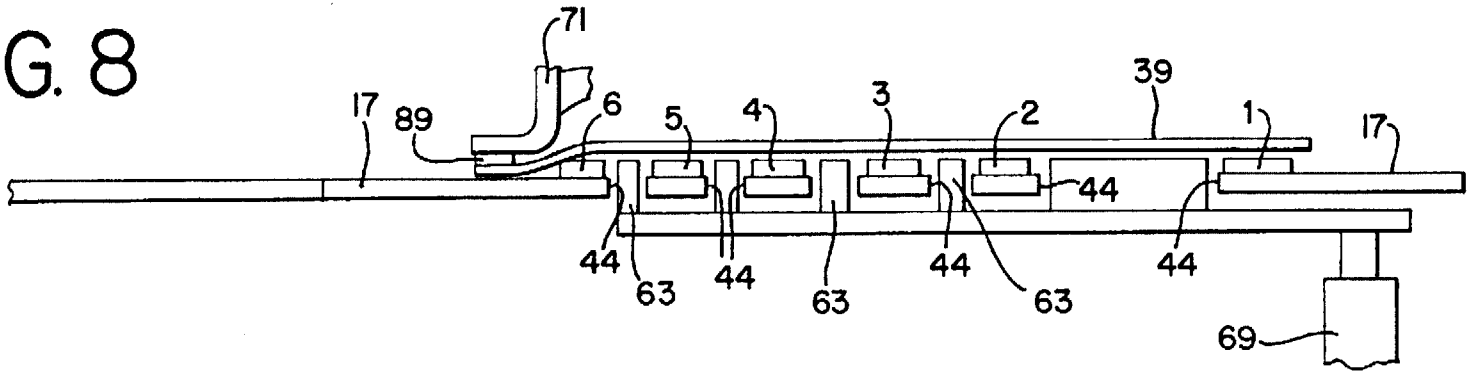
FIG. 8 is a cross-sectional view of the sleeve lift bar actuation mechanism.

The sleeve stop lift bar device 63 is best seen in FIGS. 7 and 8. The sleeve lift bars 63 extend parallel to the conveyor belts and are carried by a base plate 67 that is located below the smooth surface 17. The base plate 67 is mounted to a power guided slide actuator such as an air cylinder 69. When the stop lift bar device is used, openings 44 are formed in the smooth surface 17 through which the lift bars 63 extend. The top surface of the lift bars 63 are flush with or slightly above the smooth surface 17 prior to being actuated by the air cylinder 69. After the air cylinder 69 has been actuated, the top surfaces of the lift bars are elevated above the smooth surface 17 and above the upper surface of the conveyor belts 1–7. After the sew sensor 57 recognizes the edge of the moving sleeve blank 39, and after a programmed count or time or pulses, the air cylinder 69 receives an actuation signal from the central processor 128. Actuation of the air cylinder 69 is timed such that the sleeve blank 39 is lifted above the moving belts just a moment before the seamer sleeve clamp 71 is actuated. Once the seamer sleeve clamp 71 has captured the sleeve blank 39, the lift bars 63 are lowered below the surface of the moving conveyor belts to their original position.

The sleeve stop lift bar 63 and the sleeve stop clamp 59 can be used together or independently or not at all. When both the sleeve stop clamp 59 and the sleeve stop lift bar 63 are used, the sleeve stop lift bar device is actuated a moment, about 25 milli-seconds, after actuation of the sleeve stop clamp 59. In this mode of operation the seamer sleeve clamp 71 is actuated moments later, about 25 milli-seconds after actuation of the lift bar device.

The use of the sleeve stop clamp 59 and or the sleeve stop lift bar device is determined by the size, style and type of sleeves that are being processed and the degree of accuracy of stopping and maintaining the sleeve blanks aligned parallel to the line of feed of the hemmer and square to the line of feed of the seamer that is required.

The same mechanisms can be used to stop the sleeve blanks 39 regardless of whether the LES technique or the TES technique are being used. If the TES technique is being used, the sew sensor 57 looks for the trailing edge 51 of the sleeve blank 39, then after a pre-determined pulse count or time, actuates the seamer transport clamp 71 to deliver the sleeve blank 39 to the seaming sewing head. Again, if accuracy is paramount, then the lift bars 63 and or the sleeve stop clamp 59 are used.

After the sleeve blank 39 has been brought to a stop at station 4, it is grasped along the hemmed edge 55 by the seamer clamp 71 and transported to the sewing head of the seamer sewing machine 91. The seamer clamp 71 will be discussed with reference to FIG. 7. Seamer clamp 71 includes a cylinder 73 that is mounted on a lateral plate 75. The cylinder 73 has a movable piston 77 that is connected to a support member 79. A pair of opposed side bearings 81 also connecting the lateral plate 75 to the support member 79 provides stability to the support member 79 during movement of the piston 77 and support member 79. The seamer clamp 71 also includes a floating clamp 83, disposed beneath the support member 79, that is pivotally connected through a plate 85 and a pivot 87 on the support member 79. This pivot connection allows the opposed lateral ends of the floating clamp 83 to move relative to the support member 79. The opposed lateral ends of the floating clamp 83 are biased away from the support member 79 by opposed helical springs (not shown). The floating clamp 83 has a plurality of spaced friction pads 89 disposed on its bottom surface to assure proper grip against the cloth blank 39 (see FIG. 9). After the seamer sleeve clamp 71 has captured the sleeve blank 39 against the smooth surface 17 a signal is sent by the central processor 128 to the cylinder 99 of the transport device 97 causing it to be actuated and to slide the sleeve blank 39 across the smooth surface 17 to a position just forward of the sewing head of the seamer sewing machine 91.

The seamer sleeve clamp 71 is connected to a sleeve transport device 97 which, when actuated in response to a signal from the central processing unit 128, causes the clamp 71 to move to a position that is in the line of feed and adjacent the seamer sewing head of the seamer sewing machine 91. As the seamer clamp 71 moves to this position it slides the retained folded sleeve blank 39, with it over the smooth surface of the seamer work surface 17.

After the presser foot 95 is signaled by the central processing unit 128 to lower and capture the folded sleeve blank 39 and before sewing starts, the seamer clamp 71 is caused to raise and release the folded sleeve blank 39. The transport device 97 is then signaled to return the seamer clamp 71 to it's home position to be ready to retrieve another folded sleeve blank 39.

The transport device 97 moves the seamer clamp 71 and retained sleeve blank 39 along the smooth surface 17 toward the sewing head of the seamer sewing machine 91 until the seamer clamp 71 strikes a bumper 101 that functions to stop movement of the seamer clamp 71. At the same time, a seamer sew sensor 93, such as a suitable photoelectric sensor, is located to sense the hemmed edge 55 of the sleeve blank 39 in order to indicate that the material is at the proper position for sewing. In the event that seamer sew sensor 93, which is electrically connected to the central processing unit 128, does not sense the edge 55, then an adjustment screw 103 must be modified to vary the distance the sleeve blank 39 is moved by the friction pads 89 until the seamer sew sensor 93 is satisfied and at which time the seamer clamp 71 strikes the bumper 101.

When the adjustment screw 103 is properly modified in order to obtain proper sensing by the seamer sew sensor 93, and the seamer sew sensor detects the hemmed edge 55 of the sleeve blank 39, a signal is sent to the central processing unit 128. The central processing unit 128 then simultaneously causes the presser foot 95 of the sewing head of the seamer sewing machine 91 to be lowered onto the sleeve blank 39, actuates the cylinders 73 to move the floating clamp 83 upwardly from the sleeve blank 39, and actuates the cylinder 99 to return the seamer clamp 71 to its home position adjacent station 4. At its home position seamer clamp 71 is available to process a subsequent sleeve blank 39 which improves the speed and automation of the seamer assembly. At this time, the sewing head of the seamer sewing machine 91 begins sewing the sleeve blank 39, as will be further discussed below. The above discussed seamer sleeve clamp 71 and transport device 97 is similar to corresponding devices that are disclosed in U.S. Pat. No. 4,878,445, which patent is hereby included by reference as a part of this specification.

The edge guiding device used in this invention is substantially the same as those disclosed in U.S. Pat. Nos. 5,251,557, 4,467,734 and 5,370,072, and reference may be had to those patents for a more complete disclosure of the structural components of these devices.

Figure 20:
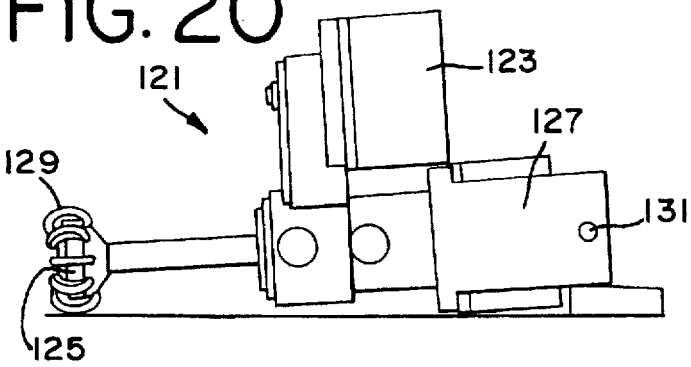
FIG. 20 is a side view of an edge guiding device of the type used in the automatic ply aligning and positioning mechanism of this invention.
Figure 22:
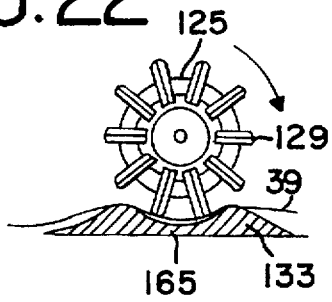
FIG. 22 is a cross-sectional view of the sleeve blank with the edge guided and the side feed belt engaged.
Figure 21:
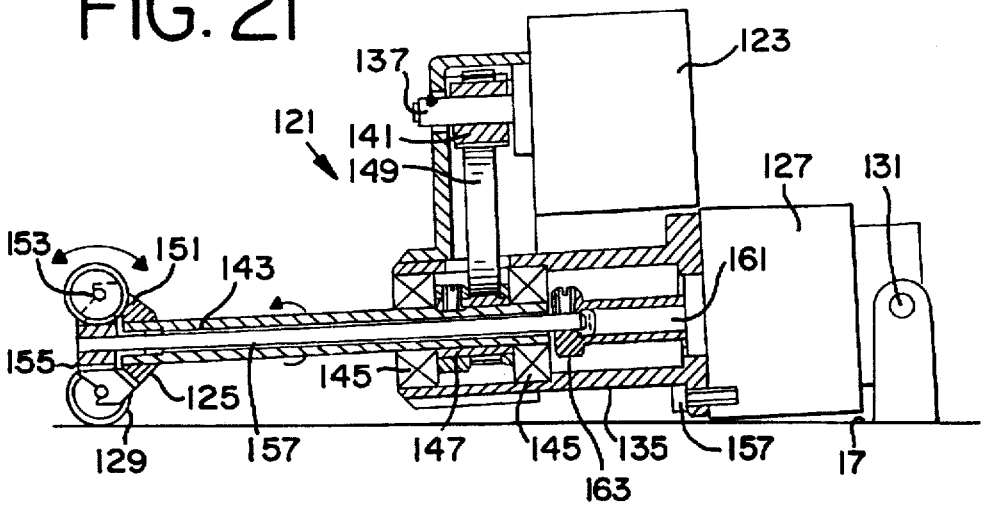
FIG. 21 is a cross-sectional end view of the guiding wheel head of the edge guiding device seen in FIG. 20.

Referring to FIGS. 20–22, the edge guider 121 has a first stepper motor 123 for driving the feeding wheel 125 that functions to advance the material in the material feed direction and a second stepper motor 127 for driving the gripper wheels 129 that function to move the material normal to the material feed direction. The stepper motors 123 and 127 can be controlled to rotate at specific speeds or for a specific number of rotations or fraction of a rotation. Thus, depending upon the diameter of the drive element and the drive ratios, a ply of material can be advanced at a desired speed that can be synchronized with the speed at which the seamer sewing machine 91 is advancing the sleeve blank 39 upon receipt of an actuation instruction from the central processor 128.

Figure 10:
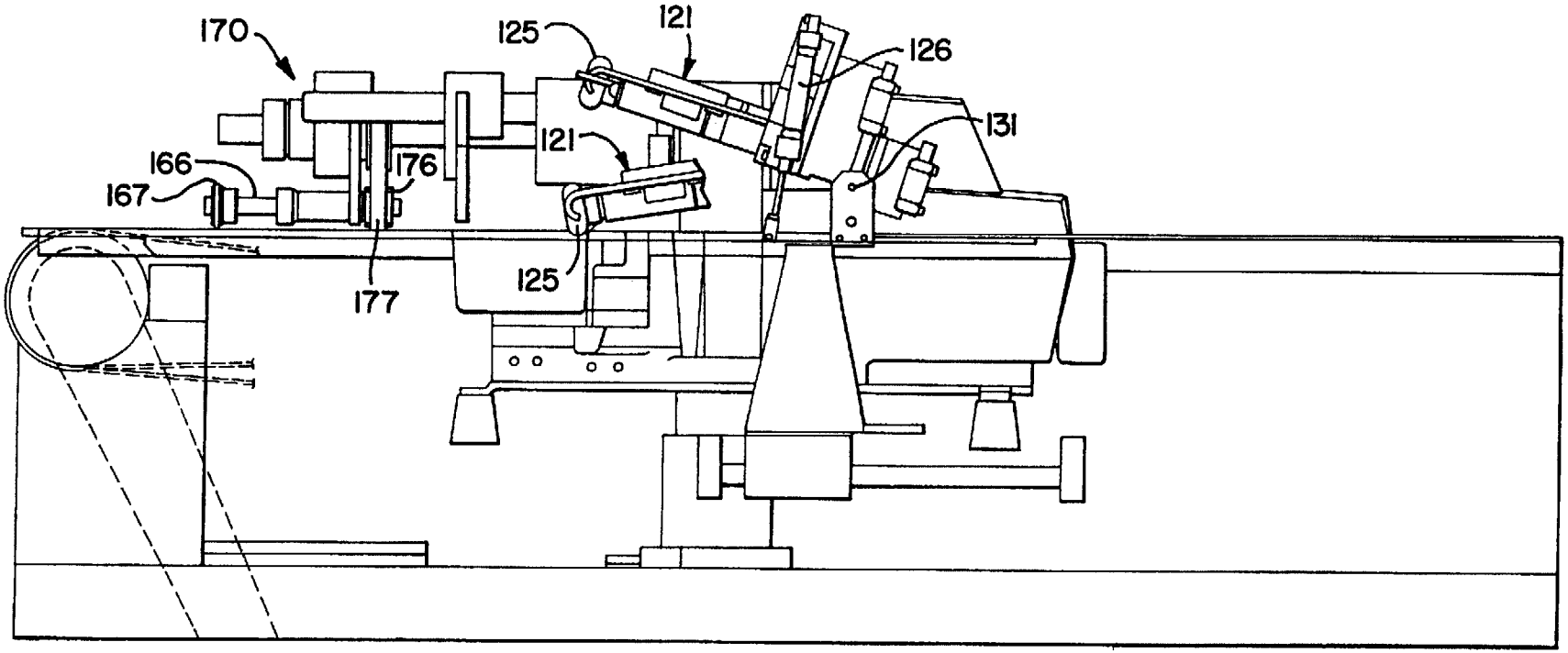
FIG. 10 is a cross-sectional view taken along lines 10—10 of FIG. 3.
Figure 11:
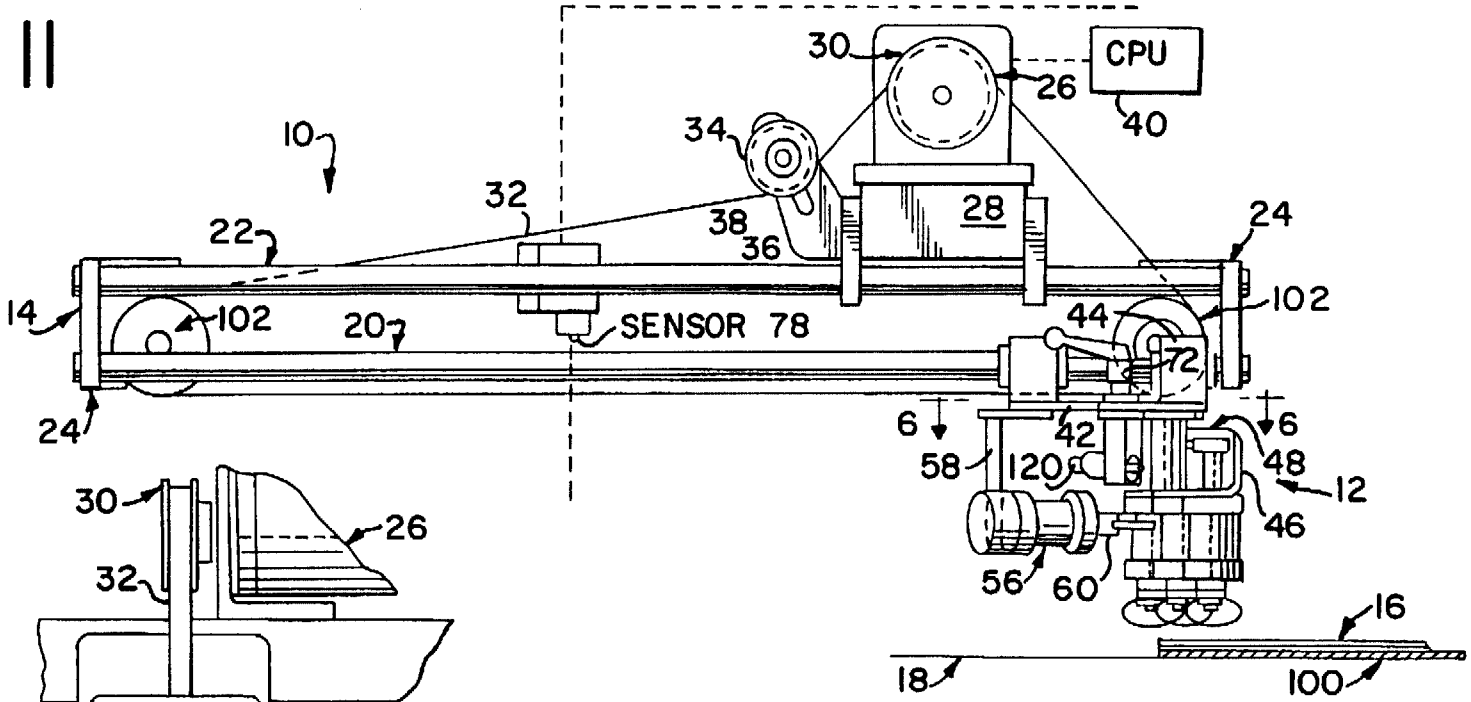
FIG. 11 is a side elevational view of an embodiment illustrating the relationship of the transport assembly, support mechanism and actuating motor.
Figure 12:
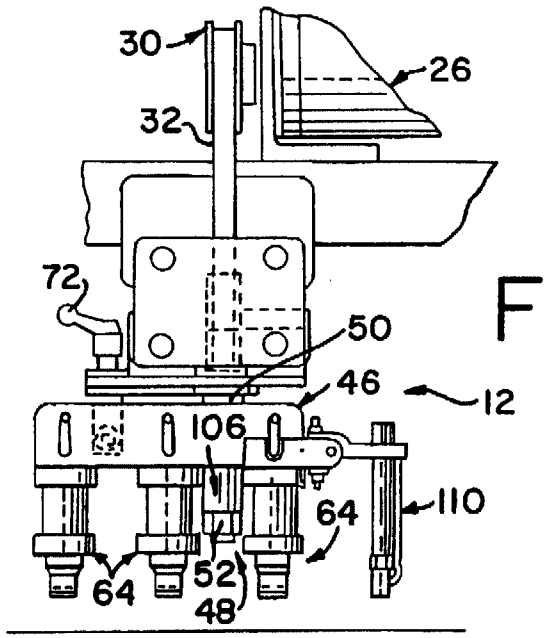
FIG. 12 is a frontal view of a transport assembly according to the invention of FIG. 11.

The edge guider 121 can be supported at one end on a horizontal pivot shaft 131. The other end, which is the material engaging head of the device, rests on the ply separator plate 133 (see FIG. 22). The material engaging head can be lifted off the ply separator plate 133 by pivoting the entire device about horizontal pivot shaft 131. As best seen in FIG. 10 a cylinder 126, controlled by the central processing unit 128, is provided to raise and lower the edge guider 121. The edge guider 121 can rely upon gravity or can include a mechanical device, such as a spring or an air cylinder, to assist in forcing the material engaging head toward the ply separator plate 133. The edge guider 121 is mounted on the support table 11 such that it can be automatically raised and lowered in response to a signal from the central processor 128.

FIG. 21 is a cross-sectional view of the edge guider 121 seen in FIG. 20. A housing 135 has the first stepper motor 123 mounted to its outer surface. First stepper motor 123 has an output shaft 137 with a pinion 141 secured thereto. A hollow shaft 143 is mounted for rotation by bearings 145 in the housing 135 and has a pinion 147 secured thereto. Pinion 147 is mechanically connected by way of a toothed belt 149 to pinion 141. Rotary drive is transmitted from stepper motor 123 through toothed belt 149 to the hollow shaft 143. A feeding wheel 125 is fixed to the free end of hollow shaft 143 and thus rotates therewith. The feeding wheel 125 has a plurality of openings 151 formed therein in which gripper wheels 129 are mounted for rotation on shafts 153. The peripheral edges of gripper wheels 129 are in driving engagement with worm gear 155 and are caused to rotate thereby. Worm gear 155 is secured to the free end of shaft 157 that is mounted for rotation within the hollow shaft 143.

The housing 135 is secured to one end of second stepper motor 127 by bolts 159. The other end of second stepper motor 127 is pivotally mounted to the surface 17 of the support table 11 about a pivot shaft 131. The output shaft 161 of second stepper motor 127 is secured to shaft 157 by a coupler 163. The feeding wheel 125 of body edge guider 121 can be lifted off ply separator plate 133 by pivoting the edge guider 121 upwardly about shaft 131.

FIG. 22 is an end view of the feeding wheel 125 and includes the sleeve blank 39. The sleeve blank 39 is located between the peripheral edge of feeding wheel 125 and the ply separator plate 133. Ply separator plate 133 has a cylindrical shaped concave surface 165 that cooperates with the peripheral edges of gripper wheels 129 to grip the sleeve blank 39 so as to feed it in the precise amount intended. As a result of the concave shape of surface 165, a plurality of gripper wheels 129 can be in engagement with the sleeve blank 39 at the same time which enhance the control and precision of this feed.

The edge guide sensor 150 used with the edge guiders of this invention are of the retro-reflective type which emit rays that are reflected back to the sensor. The emitted rays are directed at a highly reflective surface, or a surface to which reflective tape has been applied. When the ply of material moves into the area where the rays are directed there is a blockage of rays that would be reflected back to the sensor. This blockage is detected by the sensor, and thus its state is changed.

Diffuse type sensors could also be used. Diffuse type sensors recognize characteristics of a particular type of surface that they are intended to sense and do not require the presence of a highly reflective surface.

Another embodiment of seamer sleeve clamp and transfer mechanism that can be used in combination with this assembly mechanism is illustrated in FIGS. 11 through 17. This embodiment is disclosed in U.S. Pat. No. 5,159,874, which patent is hereby made a part of this disclosure by reference.

Another alternative embodiment is a combination of the sleeve transport assembly 12 of the type disclosed in U.S. Pat. No. 5,159,874 with a transport device 70 of the type disclosed in U.S. Pat. No. 4,878,445. An advantage of this combination is that the sleeve transport assembly 12 of the '874 patent provides the capability to work on both the straight-angle seams of the type shown in FIG. 19 or the straight-curved seams of the type shown in FIG. 18. Also the transport device 70 of the '445 patent is less expensive than the corresponding device of the '874 patent.

The device of the '874 patent advantageously includes a sleeve transport device 10 and a pivoting sleeve transport assembly 12 slidingly mounted upon a support assembly 14. Although the illustrated embodiment employs a single transport assembly 12, the invention may include additional transport assemblies corresponding to need or desire, such as, for example, when multiple manufacturing operations may be undertaken upon the sleeve blank 16.

The support assembly 14 can be mounted over a work surface 18. The work surface 18 is illustrative of, for example, a seamer table top or other surface over which the sleeve blank 16 will be transported from a designated pickup position upon an indexing table 100 through a plurality of processing positions until the sleeve blank has been seamed. Note that although the transport device 10 according to the invention is being explained in reference to a seaming operation, it is understood that the principles conveyed are applicable to a wide range of garment manufacturing operations which involve the transport and/or rotation of the garment component during processing.

The support assembly 14 includes guide rods 20 positioned over a work surface 18 so as to be parallel to the line of feed. The rods 20 additionally are oriented parallel to one another in a planar parallel to the plane of work surface 18.

Support rods 22 lie in a similar orientation in a plane directly above guide rods 20. The ends of guide rods 20 and support rods 22 are fixedly secured to support plates 24.

Motor 26 is mounted onto support rods 22 via a motor support assembly 28. The motor 26 is commanded by a computer of CPU 40 which controls the operation of the device 10. The motor 26 translates the rotational motion of its drive wheel 30 to a linear motion of the transport assembly 12 through a drive belt 32. The drive belt 32 passes around pulleys 102 rotatably affixed at opposite ends of support assembly 14.

The tension in drive belt 32 is conveniently adjusted via a tensioning wheel 34. The axle (not shown) of wheel 34 is releasably supported through a slot 38 in a support plate 36. The end of the axle of wheel 34 may be threadingly secured (not shown) through slot 38 and held fixedly in place via a nut (not shown). The tensioning wheel 34 may thus be positioned along the length of slot 38. As tensioning wheel 34 is in contact with the drive belt 32, positioning the tensioning wheel 34 closer to work surface 18 increases the tension in belt 32, while positioning the tensioning wheel 34 away from the work surface 18 will decrease the tension in the drive belt 32.

The various components that make up transport assembly 12 are affixed to a mounting plate 42. The mounting plate 42 itself is slidingly supported to the guide rods 20 via linear bearings 44 affixed to the top surface of the plate 42. Advantageously, the drive belt 32 is fixedly secured to the top surface of mounting plate 42, so that transport assembly 12 may be displaced along the guide rods 20, by the motor 26, from the sleeve pickup position over indexing table 100 to the seaming stations 104. By reversing the direction of rotation of the drive wheel 30, the direction of displacement of transport assembly 12 may be reversed.

A pivot arm 46 is rotatably attached below the mounting plate 42 via a pivot assembly 48. The pivot assembly 48 may include, for example, a threaded stud 50 affixed at one end to the mounting plate 42. The threaded, free end of stud 50 freely passes down through an elongated, tube-like aperture 106 in the pivot arm 46. Significantly, the tube 106 may be provided with internal, self-lubricating bushings which advantageously eliminate the need for messy lubricants, an important consideration when processing fabrics. The free end of threaded stud 50 is fixedly secured to tube 106 via an elastic lock nut 52 and thrust and spring washers 54. This configuration advantageously allows pivot arm 46 to rotate in the plane of the work surface 18 about the stud 50.

Rotation of the pivot arm 46 may be actuated by a pneumatic cylinder 56. The cylinder 56 is supported beneath the mounting plate 42 via a cylinder support bracket 58. The sliding piston 60 of the cylinder 56 is affixed at one end of the pivot arm 46 via a linkage mechanism or device 62 so that the outward thrust of piston 60 causes the pivot arm 46 to rotate clockwise about the pivot assembly 48 in the plane of work surface 18. Similarly, the retraction of piston 60 into the cylinder 56 causes a counterclockwise rotation of pivot arm 46.

The pivot arm 46 supports a plurality of sleeve gripping assemblies 64. As herein illustrated, three such assemblies 64 are attached to the pivot arm 46, but a greater of fewer number may be contemplated according to need or desire. Where smaller sleeve blanks 16 are processed, one may employ fewer gripping assemblies 64, such as the assemblies 64 immediately adjoining the pivot assembly 48. Thus, the device 10 is rendered versatile, accommodating a range of sizes of shirt sleeve blanks.

Note that at least one such assembly 64 is located inside of the pivot assembly 48, the remaining assemblies 64 located outside of the pivot assembly 48. Advantageously, this configuration contributes to reduced pivot moment and rotary inertia created by the rotation of the pivot arm 46. The performance and accuracy of the transport device 10 is thereby enhanced, because the pivoting transport assemblies 12 can accelerate and decelerate without the influence of extraneous component of inertia. Also, the radii to the gripping assembly 64 from the pivot assembly 48 may be configured to a minimum value according to the range of sizes of sleeve blanks 16 contemplated.

Each gripping assembly 64 includes a gripping cylinder 66 longitudinally mounted to the pivot arm 46 so that the sliding piston 68 of the gripping cylinder 66 is free to project perpendicularly towards the plane of work surface 18. Note that as herein embodied, the device 62 may be affixed to the outermost cylinder 66. However, the device 62 may also be affixed to an endpoint of pivot arm 46.

Each gripping assembly 64 may also include an elastic gripper loop 70 or other similar elastic end effector, such as a compression spring, that is affixed to the free end of sliding piston 68. The gripper loop 70, preferably elliptically shaped but not so limited, may be formed from standard belting material or other resilient material that allows the loop 70 to act as a spring, thereby assuring positive retention of the sleeve blank 16 against work surface 18. The elliptical shape of gripper loops 70 meritoriously allows the gripping assemblies 64 to adjust the degree of retention of the sleeve blank 16 against the surface 18, because the rigidity of the loops 70 will vary depending upon their placement upon sliding piston 68 and their orientation against surface 18.

The outside surface of gripper loops 70 may be roughened so that a frictional force is imparted to the sleeve blank 16 upon the motion of gripping assembly 64, thereby transporting the sleeve blank 16 along the surface 18. Utilizing belting material provides gripper loops 70 with such a roughened surface. However, the gripper loop 70 also serves to isolate the downward force exerted by gripping cylinder 66 so as to prevent excessive frictional force from being imparted to sleeve blank 16.

Advantageously, the pivoting arm 46 may include a sleeve clamping mechanism 110. The clamping mechanism 110 includes a pneumatic cylinder and piston 112 so as to exert a primary clamping holding action directed against sleeve blank 16 perpendicular to the plane of work surface 18. The free end of the piston may be tipped with a suitable gripping material 114 such as rubber or conveyor belting.

The clamping mechanism 110 may also exert a secondary clamping action parallel to the plane of work surface 18 and directed perpendicular to the line of feed (L.O.F.) of sleeve blank 16. This is accomplished by variably rotating cylinder 112 away from or towards pivot arm 46. To this end, clamping mechanism 110 may be provided with a retaining spring 116 and positive stops or adjusting screws 210, 220. The stops 210, 220 are secured upon a respective threaded stud 230. Variably rotating stops 210, 220 upon studs 230 increases (or releases) tension of retaining spring 116 so as to effect rotation of cylinder 112. As illustrated in FIG. 5, a clamping mechanism support bracket 300 is affixed to the pivot arm 46. Piston support bracket 280 rotates about pivot 250 on the clamping mechanism support 300. Each stud 230 is threaded through respective washers 260, 270 affixed to the sides of clamping support 300. The adjusting screws 210, 220, which press against respective washers 260, 270, are each threaded about their respective stud 230. As also illustrated, the retaining spring 116 is affixed at one end to the piston support bracket 280, and is threaded at the other end between screw 210 and washer 260. Rotating the screws 210 and 220 causes the studs 230 to be engaged or disengaged at their free ends against the piston support bracket 280. Rotating the screws 210, 220 also serves to vary the tension applied to spring 116 in order to alter the bias of support bracket 280 about the pivot 250. The degree of outward pivotal motion by bracket 280 is regulated by the spacing between the surface of the bracket 280 and the studs 230. Hence, when the free end 114 of the piston 112 is lowered against the work surface 18, an outward pivotal motion of the free end 114 results, due to the counterclockwise pivot imparted to support bracket 280 about the pivot 250. The degree of outward clamping action applied by the free end 114 can be regulated by the tension applied to the spring 116.

Preferably, the clamping mechanism 110 is rotated outwardly so as to exert slight tension on the sleeve blank 16 at its hemmed portion. This tensioning force is advantageously directed outward from the foot (not shown) of the seaming station 104. This enables the device 10 to reduce or eliminate puckering or gathering of the sleeve material at the hem 320, caused by lint or other extraneous material on work surface 18, or due to the nature of the material of sleeve blank 16. A tauter, straighter seam is thereby assured. Additionally, reducing puckering lowers the number of instances where a workpiece jams the overall device 10, thereby improving process repeatability.

Rotational pivot of the pivot arm 46 is controlled via a pivot adjustment lock 72. The lock 72, mounted onto an arm 76, rotatably affixed beneath plate 42, is threadingly engaged through an arcuate slot 74 in the mounting plate 42. The arc of slot 74 is substantially co-radial to the radius of movement of the pivot arm 46. Note that the arcuate slot 42 may be scored or marked so as to indicate the rotational displacement of pivot arm 46. The angular rotation of pivot arm 46 may be adjusted from a rotation of 0 degrees (e.g., a straight, tubular sleeve would be produced) to other desired rotation angles, limited in part by the length of arcuate slot 74. The rotation of pivot arm 46 may be configured to produce a user-determinable range of seam angles 305 on sleeve blank 16. Additionally, the operator may compensate for any positional or angular variances of sleeve blank 16.

A shock absorber 120 is affixed to the lower portion of pivot lock 72. The shock absorber 120 strikes a plate 122 affixed to pivot arm 46, thereby halting the rotation of the pivot arm 46 at a pre-designated rotation angle. By releasing the lock 72, one may manually realign the pivot lock 72 in the slot 74 so as to adjust the desired angular rotation of the pivot arm 46 and, consequently, the seam angle produced on sleeve blank 16. Relocking the pivot adjustment lock 72 secures the revised position of the pivot arm 46. Note that this adjustment mechanism further allows the device 10 to process sleeve blanks 16 of varying shapes and sizes, the size and shape characteristics of each sleeve blank 16 dictating the degree of rotation required to properly produce the desired pure straight/angled seam.

Figure 13:
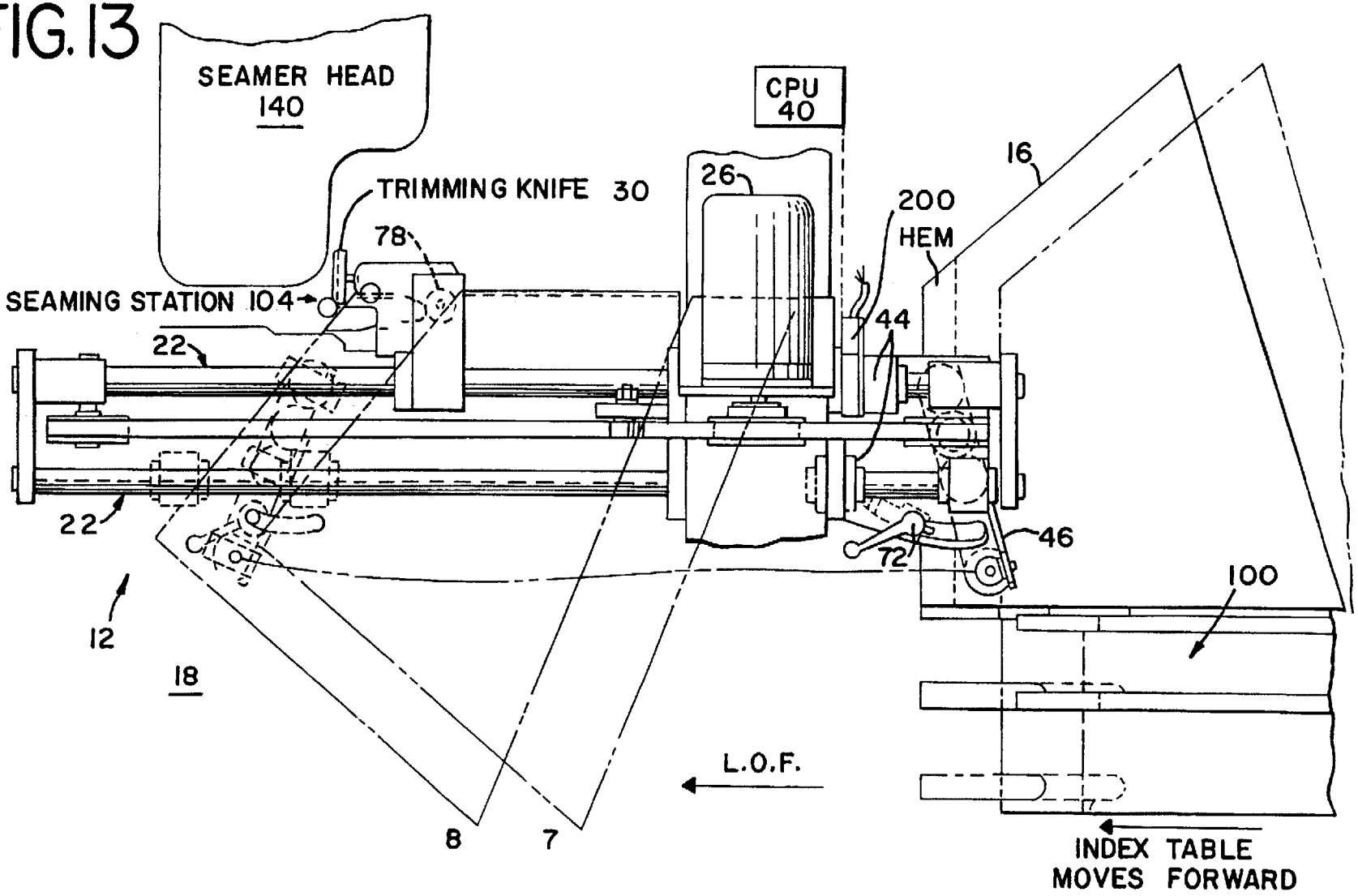
FIG. 13 is a top view of the embodiment of FIG. 11 illustrating the construction of the transport assembly and the position thereof during transport of a pre-hemmed sleeve blank.
Figure 14:
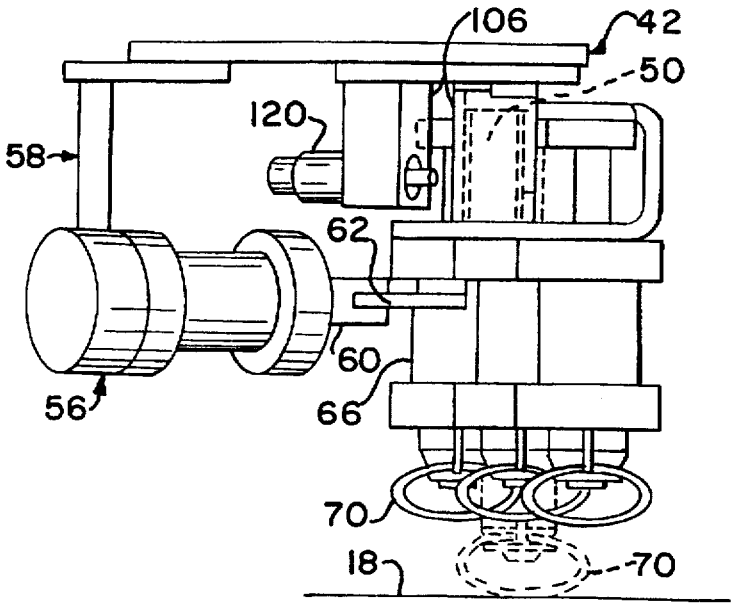
FIG. 14 is a side view of a transport assembly illustrating the relationship of the grippers and actuating cylinder to the pivot point on the pivot arm.
Figure 15:
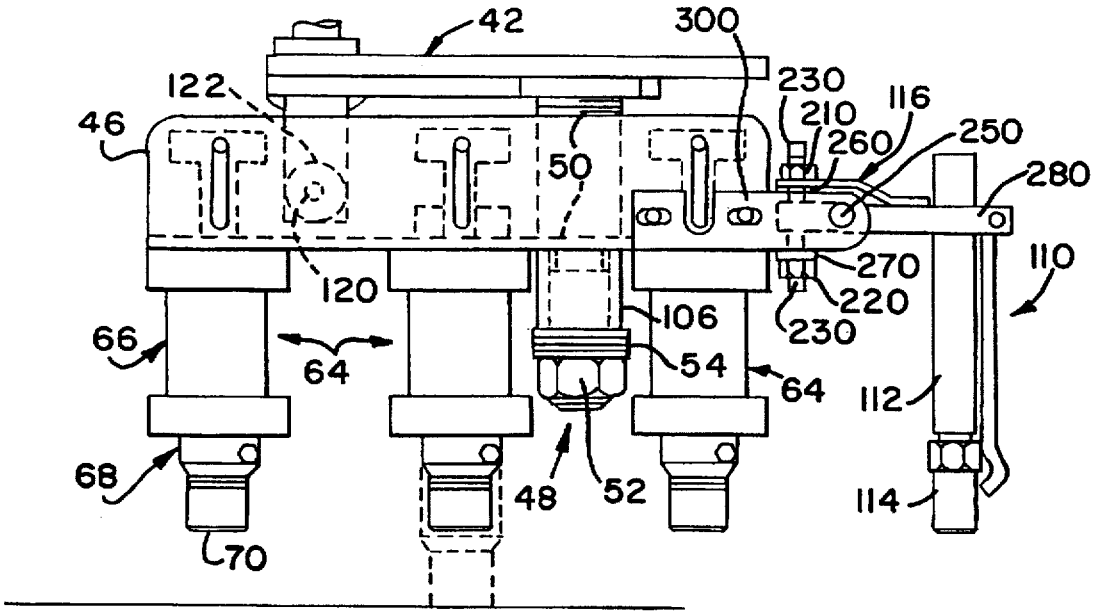
FIG. 15 is a front view of a transport assembly according to the invention showing the right-handed clamp and illustrating the construction of the gripper assemblies and their relationship to their actuating cylinders.
Figure 16:
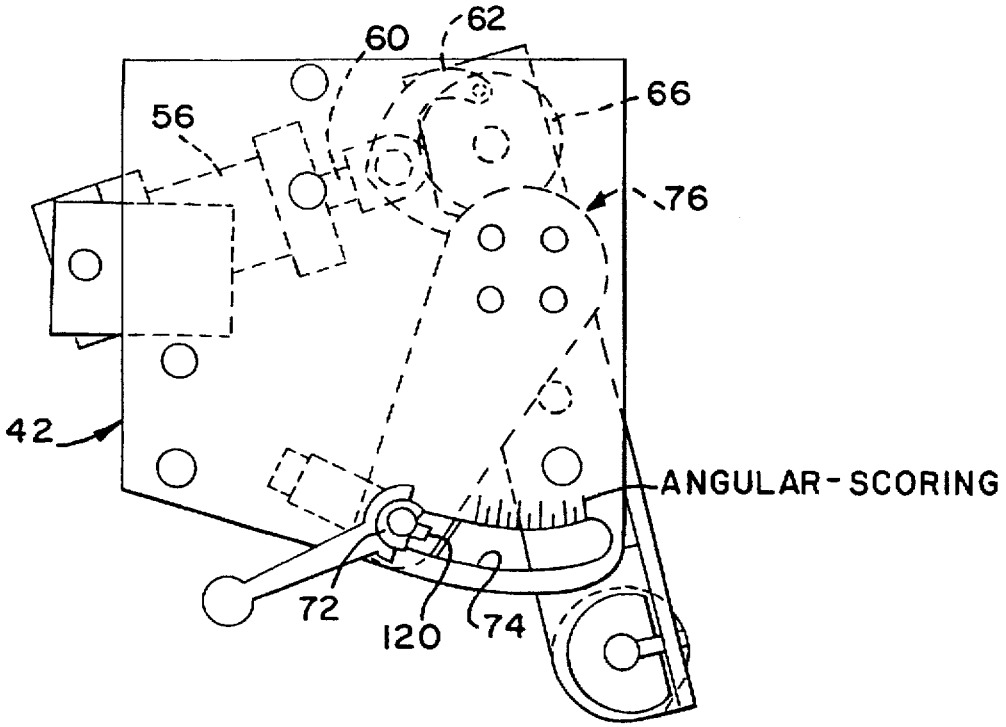
FIG. 16 is a top view of the transport assembly according to the invention showing the pivot lock and pivoting action of the pivot arm.
Figure 17:
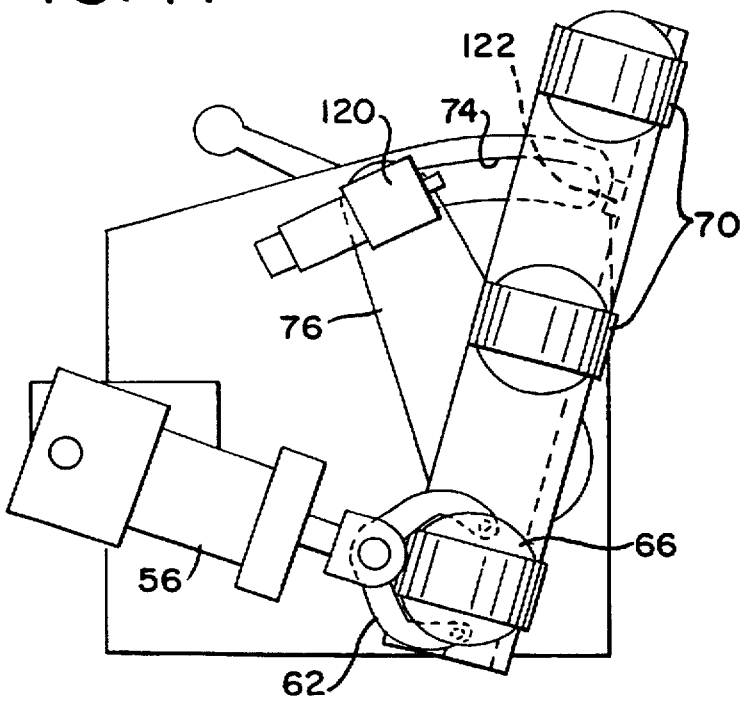
FIG. 17 is a bottom view of the embodiment of FIG. 16.

Referring now to FIG. 13, located over work surface 18 is a sew sensor 78, preferably photoelectric but not so limited. The sensor 78 is located a fixed distance from the trimming knife 130 and is in line with the knife 130 along the line of feed (L.O.F.). Advantageously, the sew sensor 78 allows the device 10 to compensate for variances in the final sleeve position relative to the seamer trimming knife regardless of the initial position of the sleeve blank 16 on the indexing table 100, or due to subsequent positional or angular variations that occur as sleeve blank 16 is transported across work surface 18. This is accomplished by resetting the counter of motor 26 when the edge of sleeve blank 16 approaches the knife 130. The sew sensor 78 will reset the counter of motor 26 just before sleeve blank 16 comes into contact with knife 130.

The sew sensor 78 lies a fixed, known distance from the seamer head 140. Thus, the transport of the sleeve blank 16 to the seamer head 140 may be adjusted by the motor 26 so as to compensate for the initial sleeve blank positioning on the indexing table 100. Advantageously, this initial positioning is noted by a sensor 200 (preferably photoelectric, but not so limited) located approximately above the indexing table 100, thereby initializing the positioning of the transport assembly 12 and establishing a reference sleeve blank position for sew sensor 78. A feedback system is thereby established between sensors 78, 200, and motor 26 and CPU 40, allowing for the accurate resetting of the counter of motor 26 so as to insure that sewing upon the sleeve blank 16 by the latchtack needle of seamer head 140 will commence precisely at the edge of the sleeve. Process repeatability and the quality of the finished sleeve blank 16 is improved, manual intervention being significantly reduced. Alternatively, note that the device could employ any suitable motor/feedback combination that will similarly enact such positional compensation of sleeve blank 16.

The positional sequence for seaming the sleeve blank 16 will be explained. The sleeve blank 16 is subjected to positional changes undertaken by the transport assembly 12 corresponding to displacement along the line of feed (L.O.F.) from a pickup position on the indexing table 100 to final seaming. Additionally, the sleeve blank 16 will undergo a number of rotational displacements in the plane of work surface 18 as the sleeve blank 16 proceeds from its pickup position to its final, seaming position.

A sleeve blank 16 is initially located on an indexing table 100, corresponding to, for example, the dropoff location of sleeve blank 16 as it emerges from a hemming operation. Note that the sleeve blank 16 may be pre-folded and oriented inside out so as to be properly oriented for presentation to the seaming station 104. The indexing table 100 moves forward on sliding means (not shown) so as to present sleeve blank 16 for pickup by transport assembly 12.

Transport assembly 12 engages a sleeve blank 16 against the indexing table 100. The gripping cylinders 66 receive a signal from the CPU 40, thereby lowering the elastic gripper loops 70 into engagement with the sleeve blank 16 against the indexing table 100. Note that for smaller sized sleeve blanks 16, only two sleeve gripping assemblies 64 would be necessary, e.g., the gripping assembly inside of the pivot assembly 48 and the one immediately outside thereof.

Referring to FIG. 13, the transport assembly 12 now proceeds to transport the sleeve blank along the line of feed upon the work surface 18 towards the seaming station 104. Next, the transport assembly 12 is alternately accelerated and decelerated by the motor 26, and the pivot arm 46 is rotated through the predetermined seaming angle, established by pivot lock 72 by the cylinder 56. Advantageously, the clamping mechanism 110 is engaged, exerting a primary clamping action against work surface 18 and a sleeve tensioning action parallel to work surface 18 to remove any puckering, ballooning or gathering of the sleeve blank 16 at its hem. The sleeve blank 16 continues to be transported along the line of feed towards the seaming station 104 until the edge of the sleeve blank 16 passes the sew sensor 78.

The sleeve has now been rotated through its predetermined seaming angle, and has been substantially decelerated when detected by the sew sensor 78, substantially corresponding to the proper trim and sewing orientation to produce the pure straight/angled seam contemplated by the invention. Note that sew sensor 78 detects the edge of the sleeve blank 16, and, as previously explained, provides input to the CPU 40 so that the motor 26 may compensate for variances in the final seaming position of the sleeve blank 16 relative to the trimming knife 130 of the seamer 104 regardless of the initial position of sleeve blank 16 on the indexing table 100, or other positional variances that may arise as sleeve blank 16 travels along work surface 18.

The sleeve blank 16 is thus transported by transport assembly 12 to the seaming station 104 at a final seaming position. Note that the previous positional compensation assures that seaming will commence at the edge of the sleeve blank 16.

Finally, sleeve blank 16 is transported through the seaming station 104 when a pure straight/angled seam is sewn onto the sleeve blank. As embodied, the transport assembly 12 disengages from the sleeve blank 16 prior to the transporting of the sleeve blank 16 through the seaming machine, wherein other means (not shown) such as overhead conveyors engage the sleeve blank to transport it through the seaming station 104. However, the device 10 may be configured so that transport assembly 12 transports the sleeve blank through the seaming machine, such as by extending the length of support assembly 14.

The device 10 may further accommodate varying product processing times (cycle times) via an adjustment in the product transport times. Products transport times (which may be measured from the point of pickup on indexing table 100 to the end of the seaming process) will decrease as the garment size increases, in part to the increased time available for the transport assembly 12 to travel from the point of pickup on indexing table 100 to the seaming station 104. Since for a larger sized sleeve blank 12 the seaming station 104 will require a greater processing time, the larger the size of the sleeve blank 12, the device 10 will compensate by reducing the speed of the transport assembly 12 (such as by slowing the rotational speed of motor 26). Meritoriously, the slower transport speed contributes to the overall repeatability of the process and serves to reduce the dynamic loadings and noise levels while the device 10 is in operation. Hence, the reliability of the device 10 is significantly improved.

Figure 23:
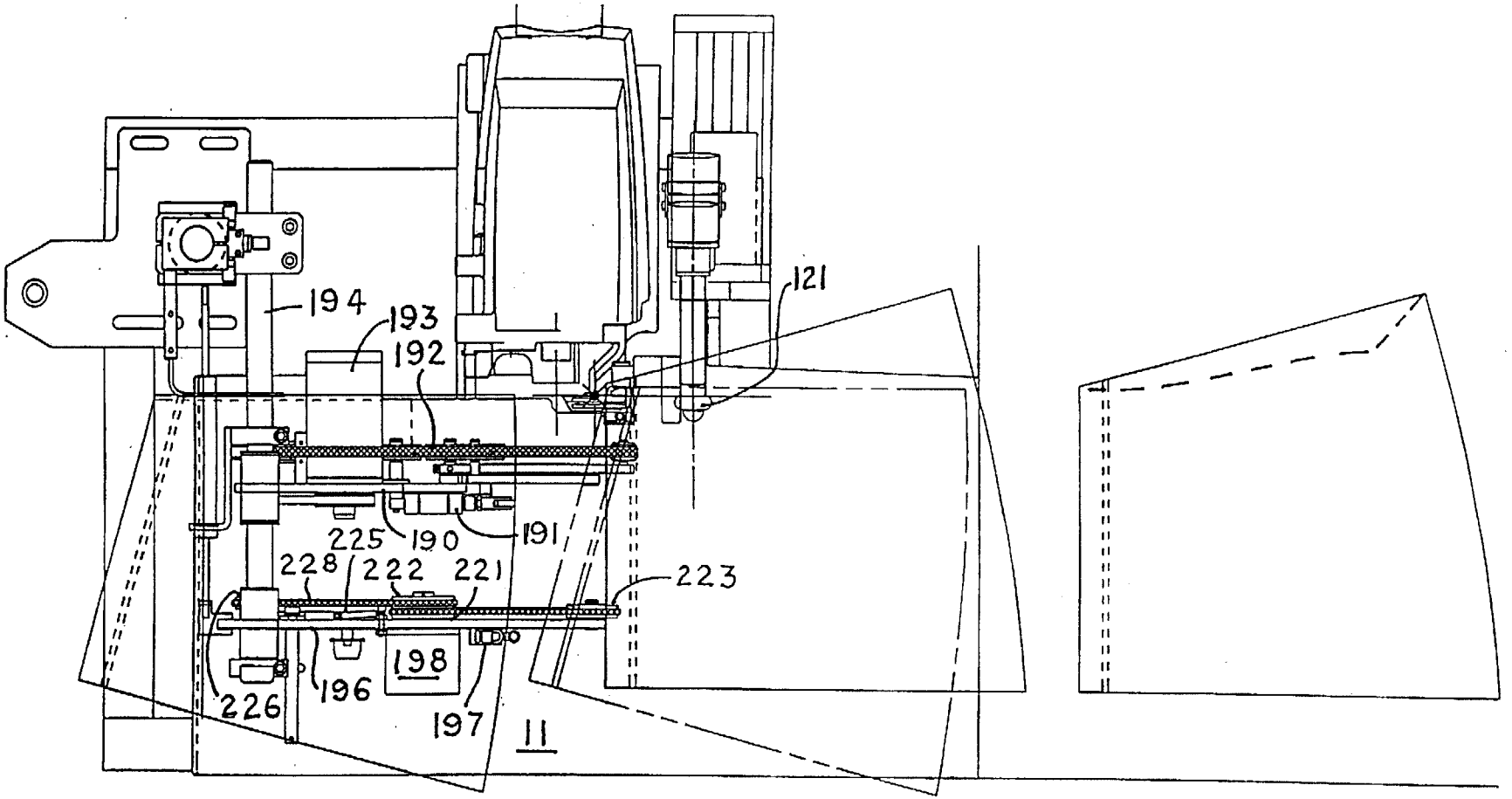
FIG. 23 is a top view of the preferred embodiment of the side belt.
Figure 24:
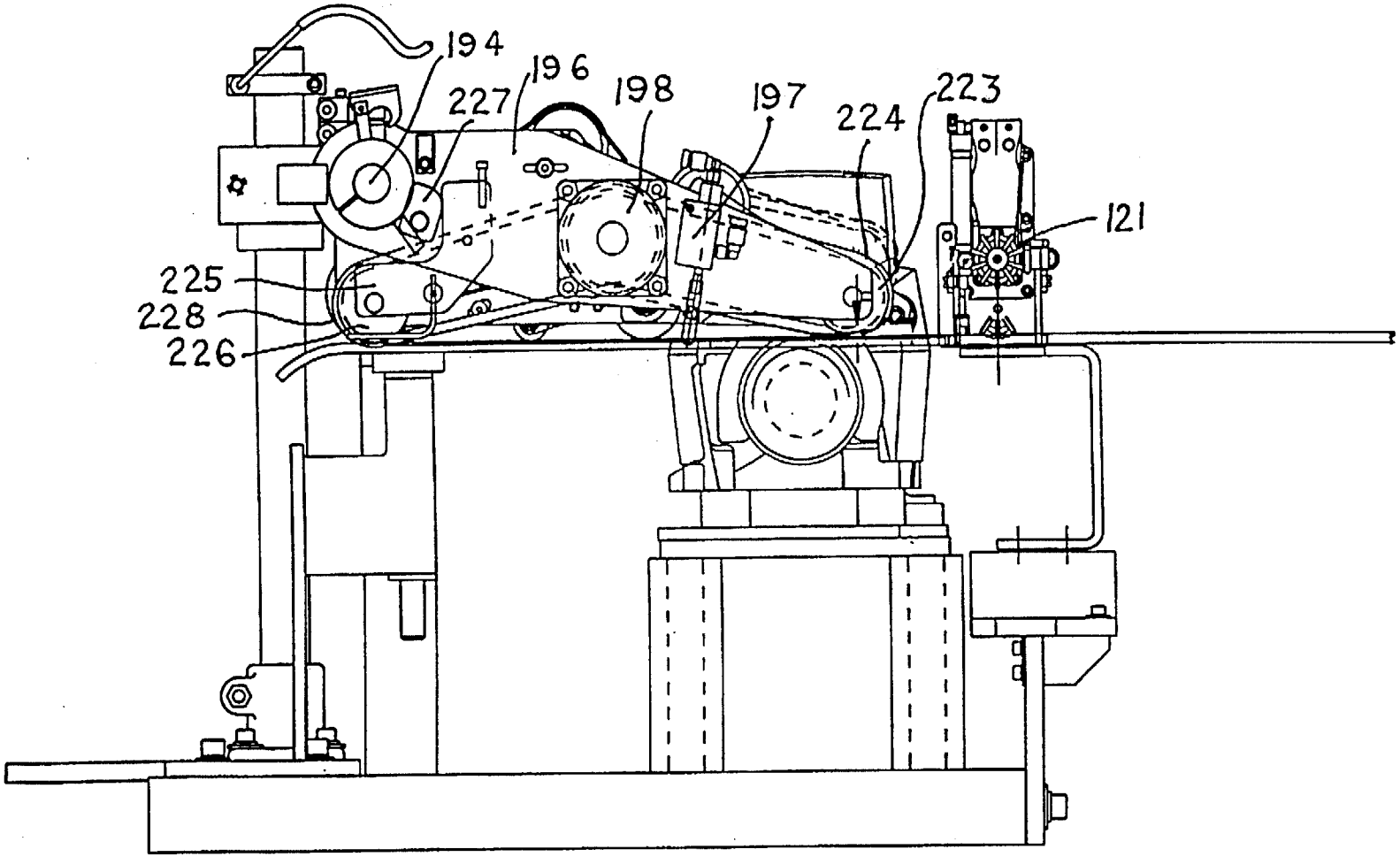
FIG. 24 is a side view of the preferred embodiment of the side belt.

Referring now to FIGS. 5, 6, 9, 23 and 24 the structure and operation of the side feed belt 170 will be discussed. An embodiment of the side feed belt 170 illustrated in FIGS. 5, 6 and 9 will be discussed first and then the preferred embodiment that is shown in FIGS. 23 and 24 will be discussed.

Figure 9:
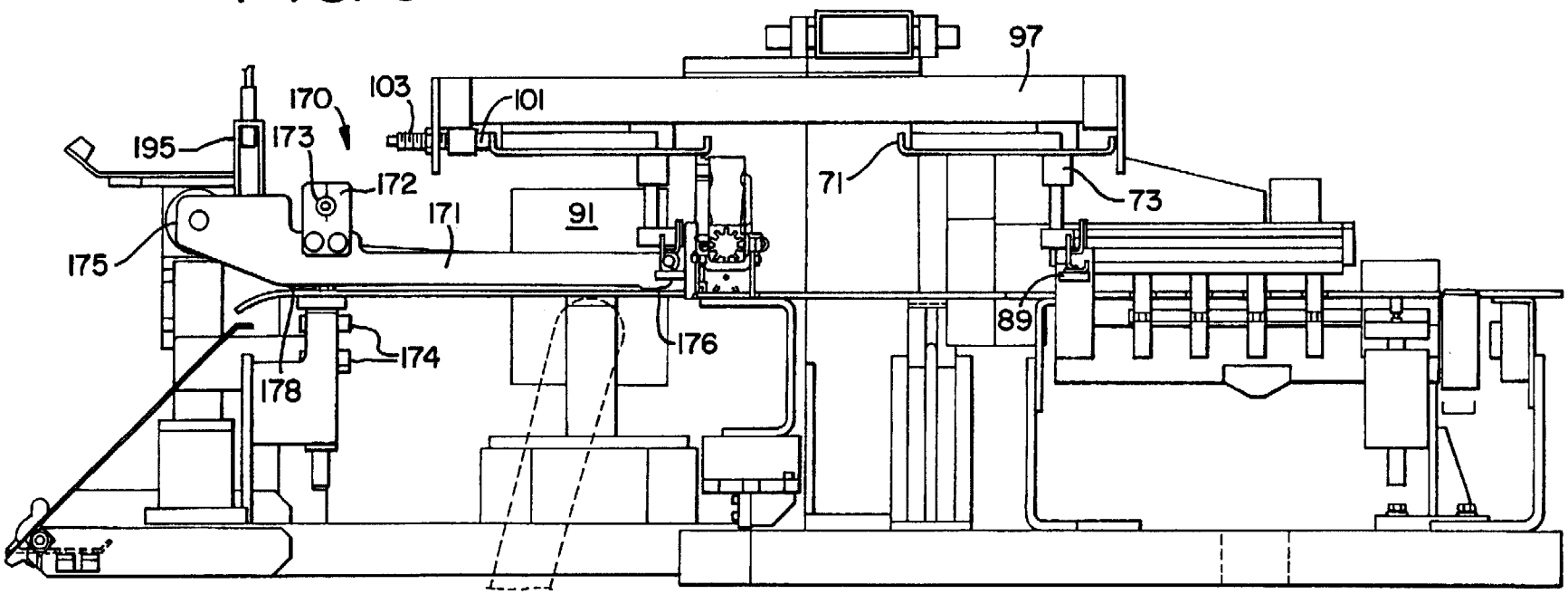
FIG. 9 is an enlarged and more detailed side view of stations 4, 5 and 6.

As best seen in FIGS. 5 and 6 the side feed belt 170 extends parallel to the direction of extent of the transport device 97. A longitudinally extending frame 171 has an upwardly extending clamp 172 secured thereto. There is a drive pulley 175 carried by one end of the longitudinally extending frame 171 and a driven pulley 176 carried by the other end. A continuous conveyor belt 177 extends over pulleys 175 and 176 and is maintained taught by an idler pulley 178. As best seen in FIG. 6 the shaft 166 that carries driven pulley 176 extends away from seaming sewing machine 91 and has a drive wheel 167 at its free end. The drive wheel 167 functions to advance the portion of the sleeve blank 39 that is furthest from the seaming sewing machine 91 at the same rate as the portion under the driven pulley 176. is being advanced. The drive pulley 175 is mounted on the output drive shaft 180 of a stepper motor 179 that is fixed to the frame of the support table 11 and is controlled by the central processing unit 128. The longitudinally extending frame 171 is journaled on the output drive shaft 180 of the stepper motor 179. As a result of this journal mounting arrangement the longitudinally extending frame 171 can pivot about the axis of drive shaft 180. The clamp 172 secures the transversely extending horizontal shaft 173 to the longitudinally extending frame 171. The other end of the transversely extending horizontal shaft 173 is secured to the free end of the piston of an air cylinder 174 that is fixed to the frame of the support table 11 and can be actuated in response to a signal from the central processing unit 128. When the air cylinder 174 is expanded the longitudinally extending frame 171 is pivoted upwardly about the axis of drive shaft 180 away from the smooth surface 17 of the support table 11. When the side feed belt 170 is lowered by the air cylinder 174 and the stepper motor 179 is actuated the bottom rung of the continuous conveyor belt 177 moves from right to left as seen in FIGS. 5, 6 and 9 and provided there is a sleeve blank 39 under the continuous conveyor belt 177 it will also be conveyed from right to left. As shall be discussed in more detail the timing for lowering the side feed belt 177 into contact with a sleeve blank 39, the duration of time that it remains down and the speed of stepper motor 179 are all controlled by the central processing unit 128.

Figure 18:
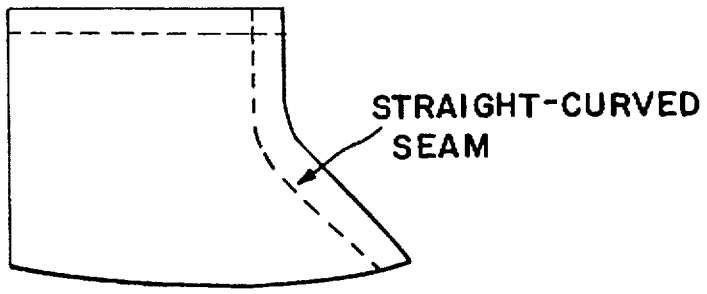
FIG. 18 represents a finished sleeve blank configured with a straight-curved seam.
Figure 19:
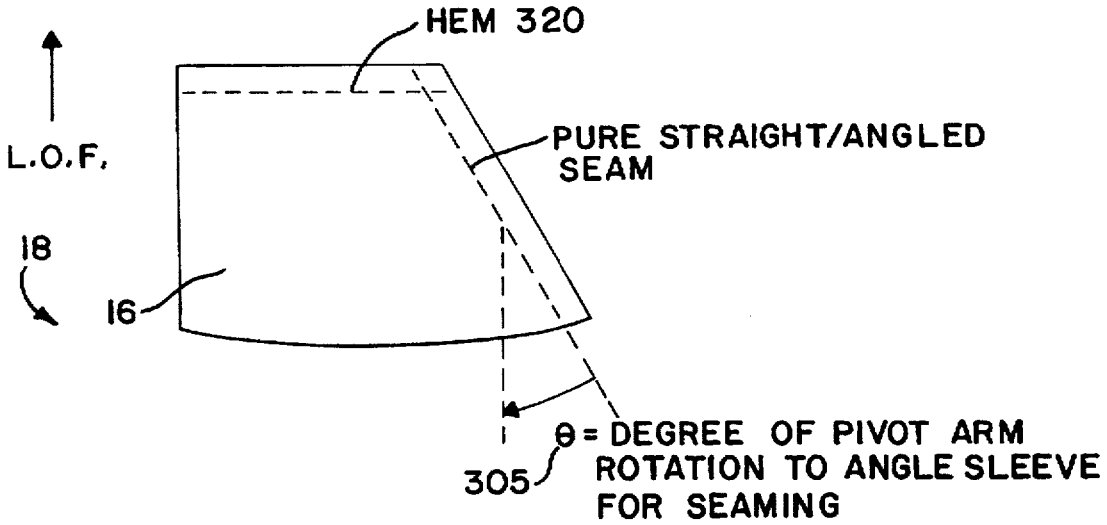
FIG. 19 represents a finished sleeve blank configured with a pure straight/angled seam.

In the preferred embodiment, seen in FIGS. 23 and 24 the same reference number have been used for components of both embodiments that are the same. This embodiment can be programmed to either produce a curved seam as seen in FIG. 18 or a straight seam as seen in FIG. 19. Thus a machine having this embodiment has the versatility to produce either type of sleeves by merely selecting a different program on the central processing unit 128. In FIG. 23, which is a top view of the preferred embodiment, a longitudinally extending frame 190 is supported by a horizontally extending bar 194. Horizontally extending bar 194 is cantilevered over the support table 11. The longitudinally extending frame 190 has a stepper motor 193 mounted thereon that drives an inner continuous conveyor belt 192. The bottom rung of continuous conveyor belt 192 is in contact with the support table 11 or a sleeve blank 39 that is located thereunder. The continuous conveyor belt 192 can be raised and lowered by the actuation of an air cylinder 191, and its speed can be changed. Raising and lowering as well as changing the speed of continuous conveyor belt 192 are controlled by the central processing unit 128.

A mounting arm 196 is carried by and is pivotally mounted on the horizontally extending bar 194. Mounting arm 196 can be pivoted toward and away from support table 11 about the axis of horizontally extending bar 194 by an air cylinder 197. A stepper motor 198 is mounted on mounting arm 196 and has drive pulleys 221 and 222 secured to its output shaft. A front driven pulley 223 is carried by mounting arm 196. A first outer continuous belt 224 extends over drive pulley 221 and driven pulley 223. A lever arm 225 is pivotally connected to the mounting arm 196 and carries a rear driven pulley 226. A cam 227 is provided for pivoting lever arm 225 and the rear driven pulley 226 relative to the mounting arm 196. A second outer continuous belt 228 extends over drive pulley 222 and rear driven pulley 226. It should be noted that since the drive pulleys 221 and 222 are at a higher elevation, relative to the support table 11, than the driven pulleys driven pulleys 223 and 226, the continuous belts 224 and 228 make line contact with the support table 11 or the sleeve blank 39 carried thereby. The gap between the line contact of the continuous belts 224 and 228 allows the sleeve blank 39 to pivot as shall be further discussed.

A curved seam of the type seen in FIG. 18 is produced on the embodiment disclosed in FIGS. 23 and 24 as follows. It should be noted that, as best seen in FIG. 18, a curved seam usually has an initial straight section, a curved section and a final straight section. Often the straight sections are short and most of the edge is curved. The relative lengths of the straight and curved sections depends upon the pattern for the garment being sewn. The embodiment disclosed in FIGS. 23 and 24 can automatically produce any curved seam required by the garment pattern. In FIG. 23 the sleeve blanks that are illustrated have been cut for straight seams of the type disclosed in FIG. 19. However, in the sleeve blank 39, to the right in FIG. 23 the edge for a curved seam is indicated in broken lines.

When the seamer transport clamp 71 moves the sleeve blank 39 to the seamer sew sensor 93 cylinder 126 is extended and the edge guider 121 is in the up or raised position as seen in FIG. 10. It is necessary for the edge guider 121 to be in the raised position to allow passage of the sleeve blank 39 and the transport clamp 71. When the hemmed edge of the sleeve blank 39 is recognized by the sew sensor 93 and after a predetermined time period the presser foot drops on the hem of the sleeve blank 39. Once the presser foot has been lowered and the sleeve blank 39 has been captured the seamer transport clamp 71 is raised and a signal is sent from the central processing unit 128 to the edge guider 121 causing it to be lowered onto the edge of the sleeve blank 39. The raised seamer transport clamp 71 is then sent back to its home position without interfering or crashing into the lowered edge guider.

As sewing begins, to produce the curved seam, both the inner belt 192 and the outer belts 224 and 228 are lowered into contact with the sleeve blank 39. As sewing commences both the inner belt 192 and the outer belts 224 and 228 are driven at the same sewing velocity as the seaming sewing machine 91. During this initial sew, the presser foot and the edge guider 121 are down and the edge guider is functioning to guide the edge of the sleeve blank 39. When the initial sew along the first straight section has been completed, the speed of the outer belts 224 and 228 are increased which causes the sleeve blank 39 to pivot, in a clockwise direction, about the presser foot. The amount of pull to be exerted on the sleeve blank 39 by the outer belts 224 and 228 is a variable that is dependent upon the shape of the curve to be sewn. This variable could be defined by either the velocity of the belts or the time that they run at the increased speed or by a combination of both. It has been found that utilizing only the length of time that the outer belts 224 and 228 are maintained at the increased speed adequately serves this purpose. During this pivoting of the sleeve blank the outer belts 224 and 228 function to eliminate any slack in the sleeve blank which will better enable the edge guider 121 to perform its functions. When the curved section has been completed the speed of outer belts 224 and 228 are reduced to the sewing velocity of the seaming sewing machine 91 and maintained at this speed until a second straight section has been completed. When the seam is completed the speed of both the inner belt 223 and the outer belts 224 and 228 are increased for the purpose of causing the sleeve blank 39 to exit the support table 11.

A straight seam of the type seen in FIG. 19 is produced on the embodiment disclosed in FIGS. 23 and 24 as follows. In FIG. 23 the sleeve blanks that are illustrated have been cut for straight seams of the type disclosed in FIG. 19. A sleeve blank 39 is transported to the stitching area in the same manner discussed above for a curved seam. As seen in FIG. 23 the edge to be seamed is at an acute angle to the direction of feed of the sleeve blank. Before sewing commences the presser foot, edge guider 121 and outer feed belt 224 are lowered into contact with the sleeve blank 39. There is a slight delay at this point in the procedure that permits the sleeve blank 39 to settle down. At the conclusion of this delay the presser foot is raised and the outer belt 224 is driven. Since the presser foot has been raised the entire sleeve blank 39 is free to pivot about the edge guider 121. The angle of the pivot is a variable that is dependent upon the design of the sleeve blank. This angle is one of the parameters that can be programmed into the central processing unit 128. When the duration of the sleeve pivot parameter expires the inner belt 192 comes down and the presser foot is lowered. Both the inner belt 192 and the outer belts 224 and 228 are driven at speeds equal to the rate of the seaming sewing machine 91. When the seam is completed the speed of inner belt 192 and outer belts 224 and 228 are increased to cause the sleeve blank 39 to exit the support table 11.

Cloth material from which apparel sleeves are made, especially material from which T-shirts are made are very soft and limp. The "pushability" of such fabric material is not good. When an edge of a sleeve blank is pushed, for example by the edge guider 121, the entire sleeve blank 39 is not likely to move, rather the edge area will move and a ripple will be formed in the fabric. Thus, although the edge guider 121 will when guiding the edge of the sleeve blank 39 attempt to control the entire sleeve blank, because of the limpness of the material it will not be successful. The edge guider 121 will require assistance at points remote from the stitch forming area. Such assistance is provided by the side feed belt mechanism 170.

Figure 25:
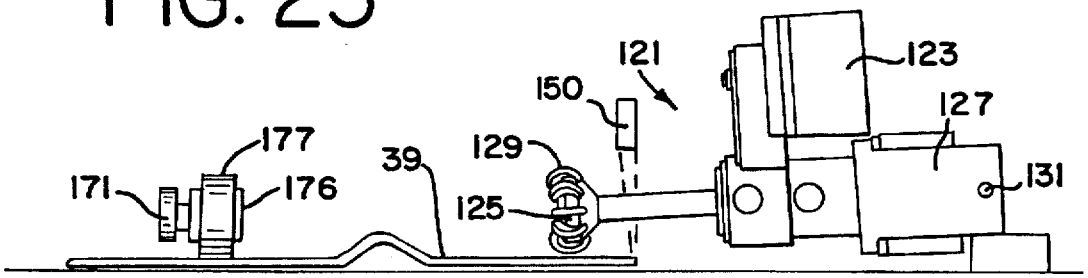
FIG. 25 is a front view of the edge guider, side belt and sleeve blank illustrating proper tension.

When programming the side feed belt mechanism 170 to speed up during the curve generation, it is very important to not over speed the sleeve because a "bubble" or relaxed tension free area between the belt and the edge guider is necessary for proper alignment to occur (see FIG. 25). If there is tension between these two points, the edge guiders would be fighting the belt action and would not have the power to pull the sleeve edge to the sensor position.

When the seamer sew sensor 93 detects the hemmed edge of the sleeve blank 39, after a predetermined delay or stitch count the edge guider 121 lifts off the sleeve blank 39. The presser foot then lifts and the seamer sewing machine goes through the latch tack cycle. The side feed belt continues to transport the sewn sleeve blank 39 to the station 7 which is the stacker station. At the stacker station the sewn sleeve blank 39 is sensed by the stacker sensor 195 and flipped onto a stacker index tray.

Figure 26:
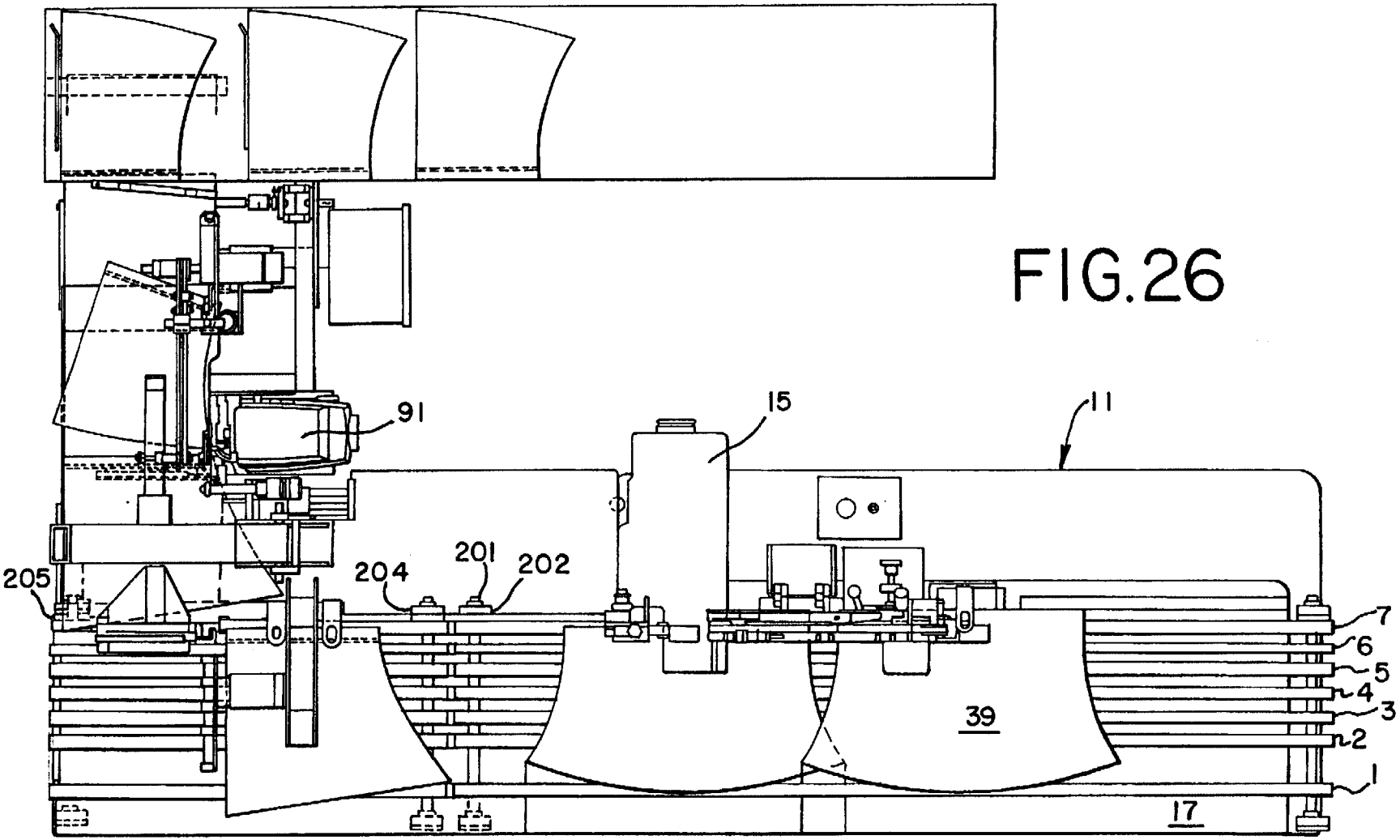
FIG. 26 is a top view of the belt speed up option.
Figure 27:
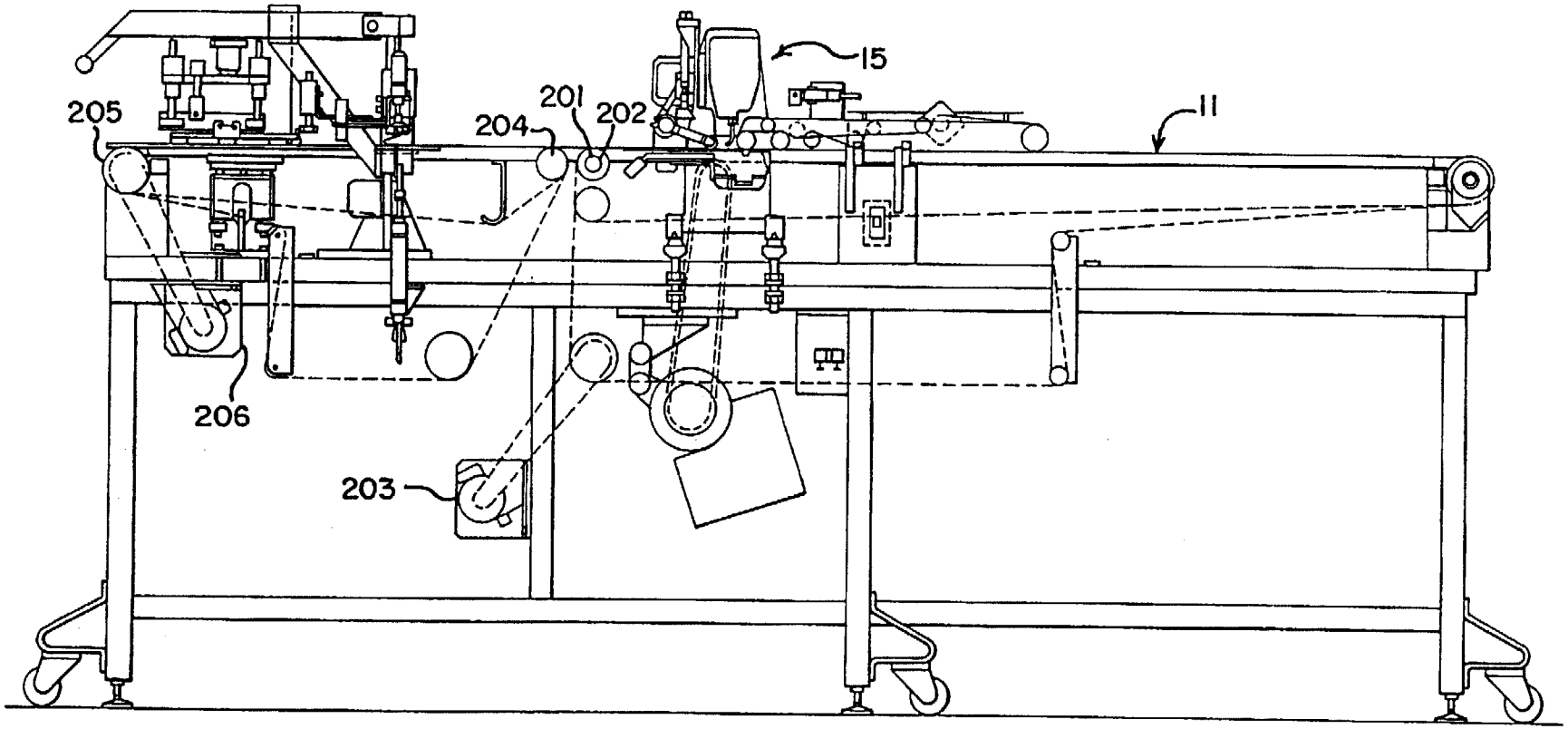
FIG. 27 is a side view of the belt speed up option.

In FIGS. 26 and 27 there is shown an alternative arrangement for transporting the sleeve blank 39 after it has been hemmed by sewing machine 15 at station 2 to station 4 where it is picked up by the seamer clamp 71. Two needle hemming has become a very desirable and popular feature in the production of apparel sleeves and is replacing the simpler blind stitch. However, two needle hemmer/seamer machines are very expensive and have increased the cost of producing apparel sleeves.

In the machine for producing apparel sleeves the operator manually places and aligns the sleeve blank 39 on the upper surfaces of the continuous conveyors 1–7 and the smooth surface 17 of the support table 11. The operator has sufficient time to load the sleeve blanks such that the tips overlap as shown in FIG. 26. By overlapping the tips more sleeve blanks can be placed on the continuous conveyors 1–7 in a given time period and thus increases the production rate and reduces cost. However, this overlapping creates problems in performing the next operation of folding the sleeve blank in half and turning it inside out. For machines that perform the operation of folding the sleeve blank in half and turning it inside out, such as the machine disclosed in U.S. Pat. No. 5,197,722, there has to be enough space between the sleeve tips so that the sleeve being folded doesn't interfere with the on coming sleeve. Sufficient space between adjacent sleeve tips is even more critical in other machines that perform this task. To eliminate the tip overlapping problem, without having the operator reduce the loading rate, a new conveyor belt section has been added that will speed up the sleeve blanks after the edge has been hemmed such that they will accelerate away from the following sleeve blank and when the final fold is made the tips are far enough apart to not interfere with the on coming sleeve blank.

The continuous conveyor belts 1–7 are shortened and extend over a set of pulleys 201 carried on a shaft 202. The continuous conveyor belts are driven by a motor drive 203. A second set of continuous conveyor belts 1'–7' extend over sets of pulleys 204 and 205 that are driven by a motor drive 206 at a faster rate than the continuous conveyor belts 1–7.

Figures 28, 28A:
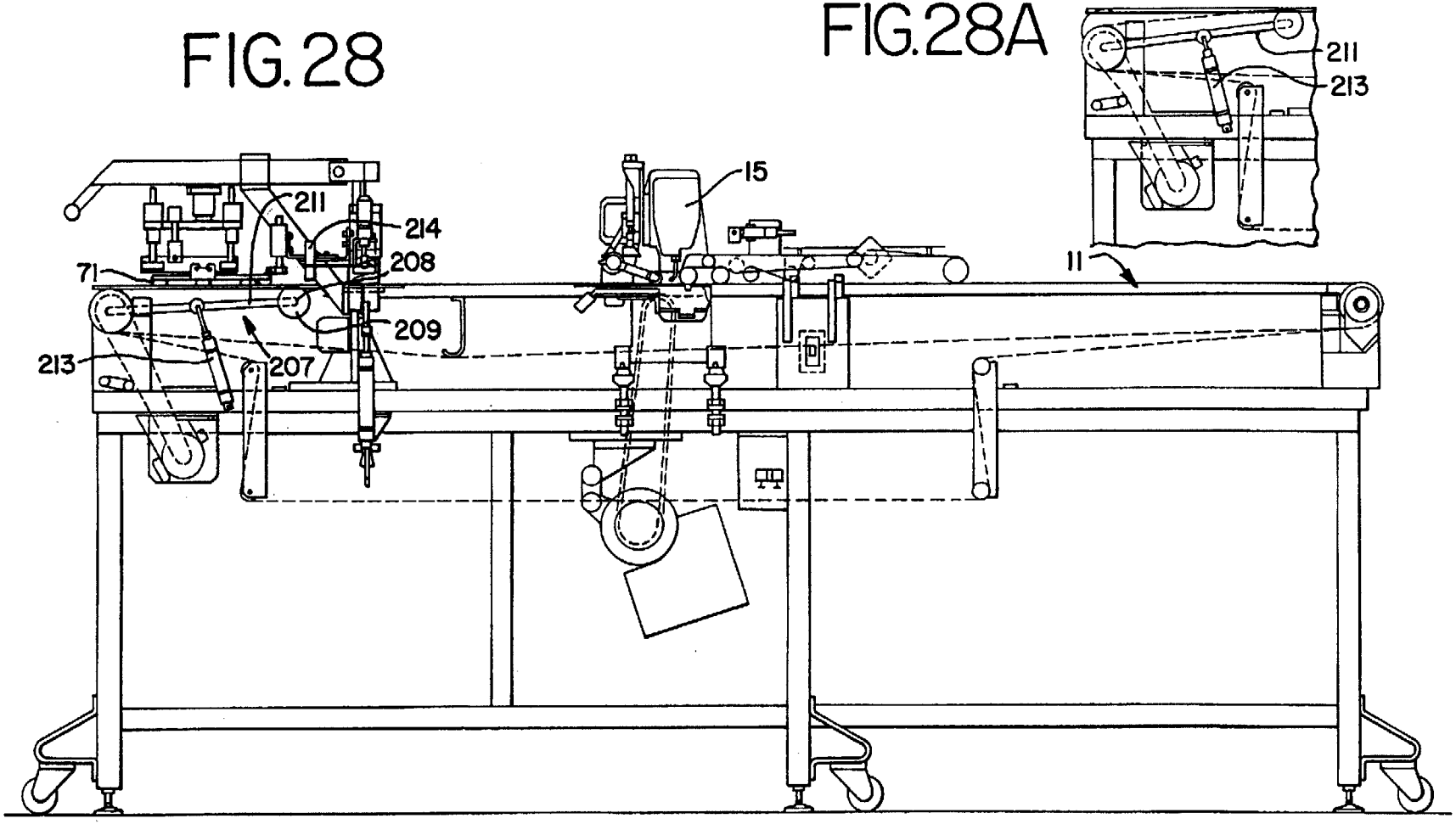
FIG. 28 is a side view of the belt drop option.
FIG. 28A is a side view of the belt in the down position.

This belt speed up option can be used with the sleeve stop clamp 59 and/or the sleeve stop lift bar device 63 of the preferred embodiment or it can be used with another optional embodiment called the belt drop concept, which is illustrated in FIG. 28.

Referring to FIG. 28 which is a side view of the belt drop option, in which the continuous conveyor belts 1–7 extend the entire length of the support table 11. However, at the end of the support table where the folded sleeve blank 39 is picked up by the seamer sleeve clamp 71 slots are cut through the smooth surface 17 of the support table 11 below the continuous conveyor belts 1–7. Thus, over this portion of the support table 11 there is no support surface 17 below the conveyor belts 1–7. A belt drop roller and frame 207 is pivotally mounted at the belt drop pivot point 208. The belt drop roller and frame includes a first set of pulleys 209 journaled at the belt drop pivot point 208 that are connected to one end of a frame 211. A second set of pulleys 212, located at the distal end on the continuous conveyor belts 1–7 is connected to the other end of the frame 211. A belt drop air cylinder 213 is mounted at the cylinder end to the frame of the support table 11 and at the rod end to the frame 211. When the trailing end of the sleeve blank 39 is sensed by sensor 214 and after a programmed time delay the cylinder 213 is caused to retract moving the route of the continuous conveyor belts 1–7 below the smooth surface 17 which stops the motion of the sleeve blanks 39 in the proper position and relationship to the sewing head of the seamer sewing machine 91.

Figure 29:
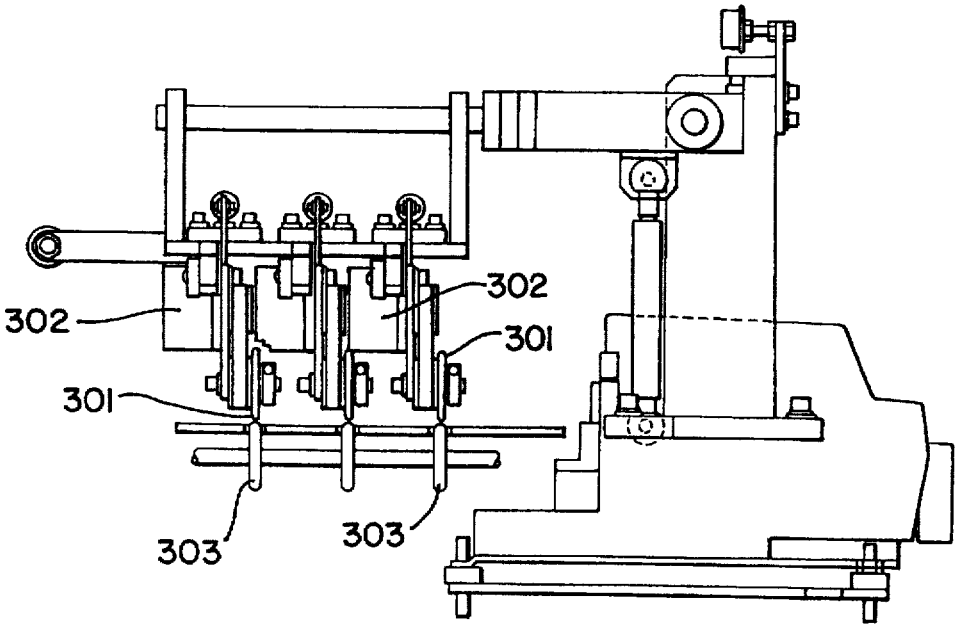
FIG. 29 is a front view of a curve generator mechanism including a plurality of stepper motor driven curve generating rollers.

Another option for a device to automatically generate the curve is illustrated in FIG. 29. In this option there are several sets of upper curve generating rollers 301 each driven by a separate stepper motor 302 or the equivalent. Under each curve generating roller there is a free wheeling idler roller 303. When the hemmed edge of the sleeve blank that is being transported into the seamer sewing head, satisfies the seamer sew sensor, the sets of upper curve generating rollers are signaled to come down onto the hem of the sleeve blank. Lowering of the sets of upper curve generating rollers 301 occurs at about the same time that the presser foot comes down.

The sets of upper curve generating rollers are driven at the same speed as the sewing head during the straight section of a seam. When a curved section of the seam is reached the speed of the sets of curve generating rollers 301 is increased proportional to the distance from the instantaneous turning center or radius of the sleeve in order to produce the curve. After the curve portion of the seam is completed the speed of the upper curve generating rollers can revert back to the linear speed of the seaming sewing machine to finish out the remaining straight segment of the seam.

Figure 30:
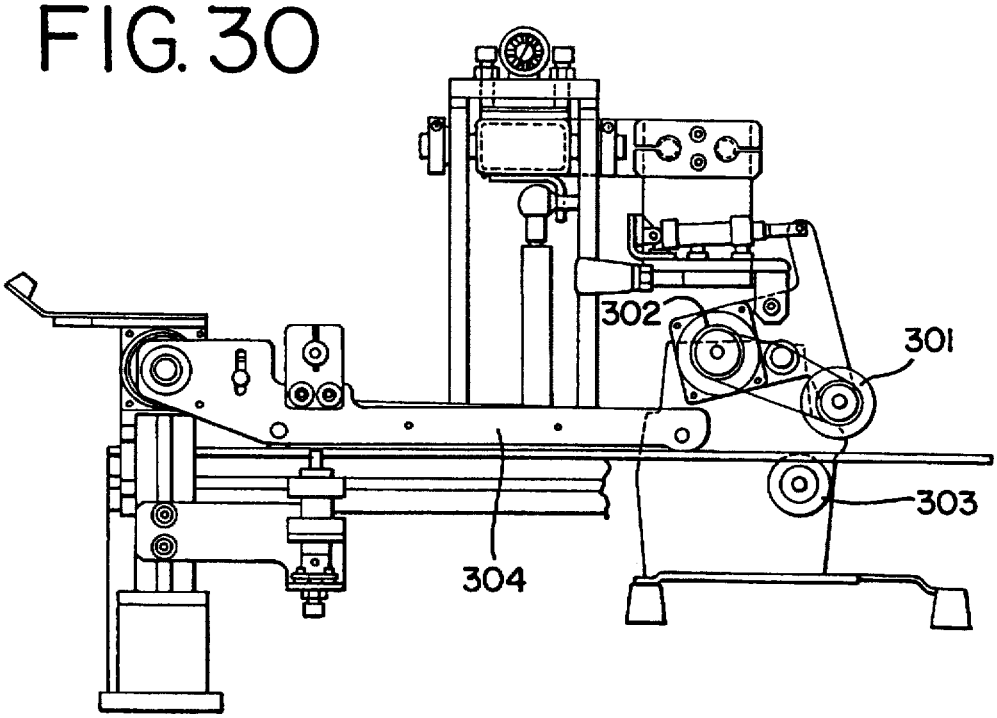
FIG. 30 is a side view of the embodiment shown in FIG. 29 including a side feed belt.

Another embodiment of the curve generating mechanism is illustrated in FIG. 30. This embodiment utilizes the curve generating rollers 301 disclosed in FIG. 29 and further includes a side feed belt 304 that is driven by a stepper motor synchronized with the sewing speed. This side feed belt 304 helps or assists feeding of the sleeve blank during sewing and curve generation and to discharge the sleeve away from the sewing area into the stacking area after the seaming is completed. A side feed belt such as this is needed to help push large heavy sleeves made of soft, flexible cloth to prevent stalling or bunching up of the material behind the presser foot.

Another feature that could be used in combination with this option is the provision of a photo cell "PEG" to sense the margin edge of the sleeve during sewing and to perform edge guiding by increasing the speed of the sets of upper curve generating rollers 301 if the sensor is covered or by slowing down the rollers 301 if the sensor is covered.

Figure 31:
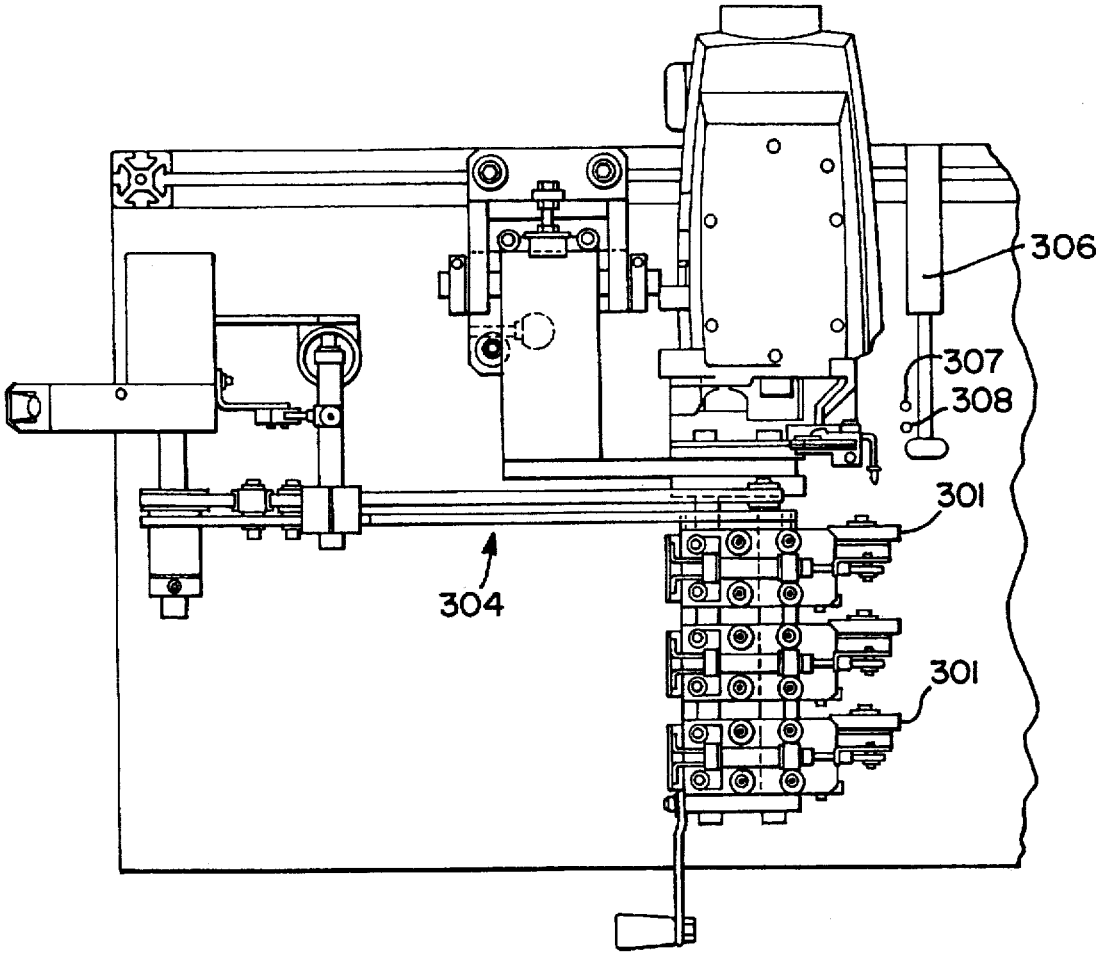
FIG. 31 is a top view of the embodiment shown in FIG. 29 that includes an edge guider.

The embodiment disclosed in FIG. 29 could be modified by providing an edge guider 306, as illustrated in FIG. 31 of the type disclosed herein in front of the seamer head to accurately guide the margin edge into the sewing machine. The edge guider 306 could be used with a single photocell or could be used with two sensors 307 and 308 side by side that would control the speed of the upper curve generating rollers to maintain the seam between the sensors. In this embodiment if the seam stays between the sensors, then the speed of the upper curve generating rollers are maintained at the same speed as the seaming sewing machine, otherwise the speed would be automatically adjusted according to whether the sensors were covered or uncovered.

Thus, the present device provides a convenient way for transporting upon a work surface workpieces from a central indexing location to a seaming station or other stitching station, thereby allowing said workpiece to be accurately seamed at a user determinable seam angle, while compensating for any positional or angular variances of the workpiece on the work surface.

We claim:

1. An apparatus for automatically producing shirt sleeves of the type that includes a central processing unit, a support table having a smooth upper surface over which a continuous conveyor for transporting a sleeve blank extends, a trimming and hemming machine for forming a hem along a straight edge of said sleeve blank, a mechanism for folding the hemmed sleeve blank and turning it inside out, and wherein the improvement comprises:

an edge guide fixed relative to said support table along an edge along which the hemmed edge is transported by said continuous conveyor and adjacent to said mechanism for folding the hemmed sleeve blank and turning it inside out;

a plurality of air conduit tubes, having discharge openings, mounted above said support table such that air jets from said discharge openings are directed toward said edge guide; and said edge guide extends from a location along said support table that is before the location where said shirt sleeve blank is engaged by said mechanism for folding the hemmed sleeve blank and turning it inside out to a location along said support table that is beyond where said shirt sleeve blank is engaged by said mechanism for folding the hemmed sleeve blank and turning it inside out.

2. The invention as set forth in claim 1 wherein said apparatus further includes:

a sensor that recognizes an approaching sleeve blank as it is being transported away from said trimming and hemming machine and as it approaches said mechanism for folding the hemmed sleeve blank and turning it inside out, said sensor transmits a signal to said central processing unit indicating the approach of a sleeve blank to the mechanism for folding the hemmed sleeve blank and turning it inside out;

said central processing unit, in response to receiving this signal, sends a signal that initiates the air jet flow from said air current ducts.

3. The apparatus as set forth in claim 2 wherein the invention further includes:

a series of photo cells mounted along said fixed edge guide that send a first signal to said central processing unit when they are covered by the presence of a sleeve blank against said fixed edge guide and a second signal when they are not covered by a sleeve blank;

said central processing unit sends a signal, in response to said first signal, to reduce the intensity of said air jets, and in response to said second signal to increase the intensity of said air jets.

4. An apparatus for automatically producing shirt sleeves of the type that includes a support table having a smooth upper surface over which there is a transport mechanism for transporting a hemmed and folded sleeve blank to the sewing head of a seaming sewing machine and a curve generator for controlling the sleeve blank during the formation of a seam along an edge having a predetermined contour wherein the improvement comprises:

a sensor that recognizes the hemmed edge of the sleeve blank when it is transported to the sewing head of the seamer sewing machine;

an edge guide device that can be positioned to engage the upper surface of the sleeve blank and exert a feeding force to the sleeve blank in the line of feed of the seamer sewing machine that is synchronized with the velocity of the seaming sewing machine and also exert feeding forces to the sleeve blank in the directions normal to the line of feed of the seamer sewing machine in response to signals received from said edge guide sensor, such that the trailing edge of the sleeve blank will maintain a constant relationship with the sewing head of the seaming sewing machine during the seaming operation;

an edge guide assist mechanism that engages the upper surface of the sleeve blank at locations lateral to the sewing head of the seaming sewing machine, said edge guide assist mechanism capable of feeding the sleeve blank at a rate in excess of the velocity of the sewing head of the seamer sewing machine;

said edge guide assist includes inner and outer side belts that extend parallel to the line of feed of the seamer sewing machine and are mounted such that they can be independently raised and lowered relative to said support table into and out of contact with a sleeve blank that is being seamed, said inner and outer side belts each including independent drives to enable their drive speeds to be independently controlled such that they can be driven at or faster than the velocity of the seamer sewing machine, such that either curved or straight seams may be sewn thereby.

5. The invention as set forth in claim 4 wherein the invention further includes:

the timing and duration that said inner and outer belts are driven at speeds in excess of the velocity of the seaming sewing machine while lowered into contact with the sleeve blank and the duration for which they are driven at these speeds, being determined by the particular curve being generated.

6. A method of automatically forming a curved seam along the edge of a folded sleeve blank, comprising the steps of:

(a) transporting the sleeve blank to the sewing head of the seamer sewing machine;

(b) sensing the location of the trailing edge of the sleeve blank at the sewing head of the seamer sewing machine by an edge guide sensor;

(c) initiating sewing on the seaming sewing machine;

(d) guiding the sleeve blank by an edge guider that is controlled by said edge guide sensor;

(e) feeding the blank, in the direction of feed of the seaming sewing machine, at locations that are laterally spaced from said seamer sewing machine;

(f) pivoting the sleeve blank in the clockwise direction about the presser foot by increasing the feeding speed at the locations that are laterally spaced from said seamer sewing machine.

7. The method of automatically forming a curved seam along the edge of a folded sleeve blank, as recited in claim 6, wherein an additional step is performed:

(g) ceasing to pivot the sleeve blank in the clockwise direction about the presser foot by decreasing the feeding speed at the locations that a laterally spaced from said seamer sewing machine to a feeding speed that is equal to the feeding speed of said seaming sewing machine.

8. A method of automatically forming a straight seam along the edge of a folded sleeve blank, comprising the steps of:

(a) transporting the sleeve blank to the sewing head of the seamer sewing machine;

(b) sensing the location of the trailing edge of the sleeve blank at the sewing head of the seamer sewing machine by an edge guide sensor;

(c) lowering and maintaining an edge guider into contact with the sleeve blank;

(d) pivoting the sleeve blank in the clockwise direction about the edge guider;

(e) lower the presser foot;

(f) initiating sewing on the seaming sewing machine;

(g) guiding the sleeve blank as the straight seam is produced by maintaining the trailing edge at the location that was sensed by the edge guide sensor.

* * * * *